US009964908B2

(12) United States Patent
Nomura

(10) Patent No.: US 9,964,908 B2
(45) Date of Patent: May 8, 2018

(54) IMAGE FORMING APPARATUS, IMAGE FORMING METHOD, AND STORAGE MEDIUM TO CORRECT AN EDGE EFFECT AND SWEEPING EFFECT

(71) Applicant: CANON KABUSHIKI KAISHA, Tokyo (JP)

(72) Inventor: Yoshihisa Nomura, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 16 days.

(21) Appl. No.: 14/925,585

(22) Filed: Oct. 28, 2015

(65) Prior Publication Data

US 2016/0124368 A1 May 5, 2016

(30) Foreign Application Priority Data

Oct. 31, 2014 (JP) ..... 2014-222553

(51) Int. Cl.
*G03G 15/00* (2006.01)
*G03G 15/043* (2006.01)

(52) U.S. Cl.
CPC ..... *G03G 15/556* (2013.01); *G03G 15/043* (2013.01)

(58) Field of Classification Search
CPC ..... G03G 15/556; G03G 15/043
USPC ..... 399/27
See application file for complete search history.

(56) References Cited

U.S. PATENT DOCUMENTS

2007/0279695 A1* 12/2007 Kouzaki ..... G06K 15/02 358/3.06
2009/0016750 A1* 1/2009 Kobayashi ..... G03G 15/065 399/49
2013/0057924 A1* 3/2013 Genda ..... G06T 7/0091 358/3.27

FOREIGN PATENT DOCUMENTS

JP H1065920 * 3/1998 ..... B41J 2/485
JP 2004299239 A 10/2004
JP 2007272153 A 10/2007

OTHER PUBLICATIONS

Kato et al. Translation of JPH1065920. Published Mar. 1998. Translated Jan. 2017.*

* cited by examiner

*Primary Examiner* — Walter L Lindsay, Jr.
*Assistant Examiner* — Philip Marcus T Fadul
(74) *Attorney, Agent, or Firm* — Canon U.S.A., Inc. IP Division

(57) ABSTRACT

An image forming apparatus includes a printer engine having an exposure unit configured to form an electrostatic latent image based on data of an input image and a development unit configured to develop the formed electrostatic latent image, a specification unit configured to specify a pixel in an edge portion in which an edge-effect and a sweeping-effect are expected to occur, from among a plurality of pixels constituting the input image, and a correction unit configured to correct a toner amount with respect to the pixel in the edge portion in which the edge-effect and the sweeping-effect are expected to occur, which is specified by the specification unit, in order to suppress excessive consumption of toner caused by an effect expected to occur.

16 Claims, 24 Drawing Sheets

FIG.10

| | | CONDITION 1 | CONDITION 2 | CONDITION 3 | CONDITION 4 |
|---|---|---|---|---|---|
| EDGE-EFFECT | NUMBER OF CORRECTION-TARGET PIXELS | 6 PIXELS | 5 PIXELS | 4 PIXELS | 3 PIXELS |
| SWEEPING-EFFECT | NUMBER OF CORRECTION-TARGET PIXELS | 15 PIXELS | 10 PIXELS | 7 PIXELS | 5 PIXELS |

FIG.11B

SUB-SCANNING DIRECTION

| | | | | | | | | | | | | | | | |
|---|---|---|---|---|---|---|---|---|---|---|---|---|---|---|---|
| 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 |

FIG.11C

SUB-SCANNING DIRECTION

| | | | | | | | | | | | | | | | |
|---|---|---|---|---|---|---|---|---|---|---|---|---|---|---|---|
| 1 | 1 | 1 | 1 | 1 | 1 | 1 | 1 | 1 | 1 | 1 | 1 | 1 | 1 | 1 | 1 |
| 1 | 2 | 2 | 2 | 2 | 2 | 2 | 2 | 2 | 2 | 2 | 2 | 2 | 2 | 2 | 1 |
| 1 | 2 | 3 | 3 | 3 | 3 | 3 | 3 | 3 | 3 | 3 | 3 | 3 | 3 | 2 | 1 |
| 1 | 2 | 3 | 4 | 4 | 4 | 4 | 4 | 4 | 4 | 4 | 4 | 4 | 3 | 2 | 1 |
| 1 | 2 | 3 | 4 | 5 | 5 | 5 | 5 | 5 | 5 | 5 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 5 | 5 | 5 | 5 | 5 | 5 | 5 | 4 | 3 | 2 | 1 |
| 1 | 2 | 3 | 4 | 4 | 4 | 4 | 4 | 4 | 4 | 4 | 4 | 4 | 3 | 2 | 1 |
| 1 | 2 | 3 | 3 | 3 | 3 | 3 | 3 | 3 | 3 | 3 | 3 | 3 | 3 | 2 | 1 |
| 1 | 2 | 2 | 2 | 2 | 2 | 2 | 2 | 2 | 2 | 2 | 2 | 2 | 2 | 2 | 1 |
| 1 | 1 | 1 | 1 | 1 | 1 | 1 | 1 | 1 | 1 | 1 | 1 | 1 | 1 | 1 | 1 |

FIG.11D

| | | | | | | | | | | | | | | | |
|---|---|---|---|---|---|---|---|---|---|---|---|---|---|---|---|
| 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 |

FIG.11E

| | | | | | | | | | | | | | | | |
|---|---|---|---|---|---|---|---|---|---|---|---|---|---|---|---|
| 1 | 2 | 3 | 4 | 5 | 0 | 0 | 0 | 0 | 0 | 0 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 0 | 0 | 0 | 0 | 0 | 0 | 5 | 4 | 3 | 2 | 1 |

FIG.12B

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |

SUB-SCANNING DIRECTION

FIG.12C

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 7 | 7 | 7 | 7 | 7 | 7 | 7 | 7 | 7 | 7 | 7 | 7 | 7 | 7 | 7 | 7 | 7 | 7 | 7 | 7 | 7 | 7 | 7 | 7 | 7 | 7 | 7 | 7 | 7 | 7 | 7 | 7 |
| 6 | 6 | 6 | 6 | 6 | 6 | 6 | 6 | 6 | 6 | 6 | 6 | 6 | 6 | 6 | 6 | 6 | 6 | 6 | 6 | 6 | 6 | 6 | 6 | 6 | 6 | 6 | 6 | 6 | 6 | 6 | 6 |
| 5 | 5 | 5 | 5 | 5 | 5 | 5 | 5 | 5 | 5 | 5 | 5 | 5 | 5 | 5 | 5 | 5 | 5 | 5 | 5 | 5 | 5 | 5 | 5 | 5 | 5 | 5 | 5 | 5 | 5 | 5 | 5 |
| 4 | 4 | 4 | 4 | 4 | 4 | 4 | 4 | 4 | 4 | 4 | 4 | 4 | 4 | 4 | 4 | 4 | 4 | 4 | 4 | 4 | 4 | 4 | 4 | 4 | 4 | 4 | 4 | 4 | 4 | 4 | 4 |
| 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 | 3 |
| 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 |
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |

SUB-SCANNING DIRECTION

FIG.12D

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |
| 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 | 255 |

FIG.12E

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

FIG.15

| DISTANCE FROM EDGE | TONER HEIGHT REDUCTION RATIO | EXPOSURE AMOUNT REDUCTION RATIO [PWM] |
|---|---|---|
| 1 | -0.13 | 0 |
| 2 | 0.25 | 0.25 |
| 3 | 0.5 | 0.5 |
| 4 | 0.25 | 0.25 |
| 5 | 0.125 | 0.125 |

FIG.17

| DISTANCE FROM EDGE | TONER HEIGHT REDUCTION RATIO | EXPOSURE AMOUNT REDUCTION RATIO [PWM] |
|---|---|---|
| 1 | 0 | 0 |
| 2 | 0.3 | 0.3 |
| 3 | 0.5 | 0.5 |
| 4 | 0.45 | 0.45 |
| 5 | 0.3 | 0.3 |
| 6 | 0.15 | 0.15 |
| 7 | 0 | 0 |

FIG.18A

SUB-SCANNING DIRECTION

| | | | | | | | | | | | | | | | |
|---|---|---|---|---|---|---|---|---|---|---|---|---|---|---|---|
| 1 | 1 | 1 | 1 | 1 | 1 | 1 | 1 | 1 | 1 | 1 | 1 | 1 | 1 | 1 | 1 |
| 1 | 2 | 2 | 2 | 2 | 2 | 2 | 2 | 2 | 2 | 2 | 2 | 2 | 2 | 2 | 1 |
| 1 | 2 | 3 | 3 | 3 | 3 | 3 | 3 | 3 | 3 | 3 | 3 | 3 | 3 | 2 | 1 |
| 1 | 2 | 3 | 4 | 4 | 4 | 4 | 4 | 4 | 4 | 4 | 4 | 4 | 3 | 2 | 1 |
| 1 | 2 | 3 | 4 | 5 | 5 | 5 | 5 | 5 | 5 | 5 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 5 | 5 | 5 | 5 | 5 | 5 | 5 | 4 | 3 | 2 | 1 |
| 1 | 2 | 3 | 4 | 4 | 4 | 4 | 4 | 4 | 4 | 4 | 4 | 4 | 3 | 2 | 1 |
| 1 | 2 | 3 | 3 | 3 | 3 | 3 | 3 | 3 | 3 | 3 | 3 | 3 | 3 | 2 | 1 |
| 1 | 2 | 2 | 2 | 2 | 2 | 2 | 2 | 2 | 2 | 2 | 2 | 2 | 2 | 2 | 1 |
| 1 | 1 | 1 | 1 | 1 | 1 | 1 | 1 | 1 | 1 | 1 | 1 | 1 | 1 | 1 | 1 |

FIG.18B

SUB-SCANNING DIRECTION

| | | | | | | | | | | | | | | | |
|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 7 | 7 | 7 | 7 | 7 | 7 | 7 | 7 | 7 | 7 | 7 | 7 | 7 | 7 | 7 | 7 |
| 6 | 6 | 6 | 6 | 6 | 6 | 6 | 6 | 6 | 6 | 6 | 6 | 6 | 6 | 6 | 6 |
| 5 | 5 | 5 | 5 | 5 | 5 | 5 | 5 | 5 | 5 | 5 | 5 | 5 | 5 | 5 | 5 |
| 4 | 4 | 4 | 4 | 4 | 4 | 4 | 4 | 4 | 4 | 4 | 4 | 4 | 4 | 4 | 4 |
| 3 | 3 | 3 | 3 | 3 | 3 | 3 | 3 | 3 | 3 | 3 | 3 | 3 | 3 | 3 | 3 |
| 2 | 2 | 2 | 2 | 2 | 2 | 2 | 2 | 2 | 2 | 2 | 2 | 2 | 2 | 2 | 2 |
| 1 | 1 | 1 | 1 | 1 | 1 | 1 | 1 | 1 | 1 | 1 | 1 | 1 | 1 | 1 | 1 |

FIG.18C

SUB-SCANNING DIRECTION

| | | | | | | | | | | | | | | | | | | | | | | | |
|---|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0 |
| 0 | 0.25 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0 |
| 0 | 0.25 | 0.5 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0 |
| 0 | 0.25 | 0.5 | 0.25 | 0.125 | 0.125 | 0.125 | 0.125 | 0.125 | 0.125 | 0.125 | 0.125 | 0.125 | 0.125 | 0.125 | 0.125 | 0.125 | 0.125 | 0.125 | 0.125 | 0.125 | 0.125 | 0.25 | 0 |
| 0 | 0.25 | 0.5 | 0.25 | 0.125 | 0 | 0 | 0 | 0 | 0 | 0 | 0 | 0 | 0 | 0 | 0 | 0 | 0 | 0 | 0 | 0 | 0

FIG.18E

| | | | | | | | | | | | | | | | | | | | | | | | |
|---|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0 |
| 0 | 0.25 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.25 | 0 |
| 0 | 0.25 | 0.5 | 0.25 | 0.25 | 0.25 | 0.25 | 0.25 | 0.25 | 0.25 | 0.25 | 0.25 | 0.25 | 0.25 | 0.25 | 0.25 | 0.25 | 0.25 | 0.5 | 0.5 | 0.5 | 0.5 | 0.25 | 0 |
| 0 | 0.25 | 0.5 | 0.25 | 0.25 | 0.125 | 0.125 | 0.125 | 0.125 | 0.125 | 0.125 | 0.125 | 0.125 | 0.125 | 0.125 | 0.125 | 0.25 | 0.5 | 0.5 | 0.5 | 0.5 | 0.25 | 0.25 | 0 |
| 0 | 0.25 | 0.5 | 0.25 | 0.25 | 0.125 | 0 | 0 | 0 | 0 | 0 | 0 | 0 | 0 | 0 | 0.125 | 0.25 | 0.5 | 0.5 | 0.5 | 0.5 | 0.25 | 0.25 | 0 |
| 0 | 0.25 | 0.5 | 0.25 | 0.25 | 0.125 | 0 | 0 | 0 | 0 | 0 | 0 | 0 | 0 | 0 | 0.125 | 0.25 | 0.5 | 0.5 | 0.5 | 0.5 | 0.25 | 0.25 | 0 |
| 0 | 0.25 | 0.5 | 0.25 | 0.25 | 0.125 | 0 | 0 | 0 | 0 | 0 | 0 | 0 | 0 | 0 | 0.125 | 0.25 | 0.5 | 0.5 | 0.5 | 0.5 | 0.25 | 0.25 | 0 |
| 0 | 0.25 | 0.5 | 0.25 | 0.25 | 0.125 | 0 | 0 | 0 | 0 | 0 | 0 | 0 | 0 | 0 | 0.125 | 0.25 | 0.5 | 0.5 | 0.5 | 0.5 | 0.25 | 0.25 | 0 |
| 0 | 0.25 | 0.5 | 0.25 | 0.25 | 0.125 | 0 | 0 | 0 | 0 | 0 | 0 | 0 | 0 | 0 | 0.125 | 0.25 | 0.5 | 0.5 | 0.5 | 0.5 | 0.25 | 0.25 | 0 |
| 0 | 0.25 | 0.5 | 0.25 | 0.25 | 0.125 | 0 | 0 | 0 | 0 | 0 | 0 | 0 | 0 | 0 | 0.125 | 0.25 | 0.5 | 0.5 | 0.5 | 0.5 | 0.25 | 0.25 | 0 |
| 0.15 | 0.25 | 0.5 | 0.25 | 0.15 | 0.15 | 0.15 | 0.15 | 0.15 | 0.15 | 0.15 | 0.15 | 0.15 | 0.15 | 0.15 | 0.15 | 0.25 | 0.5 | 0.5 | 0.5 | 0.5 | 0.25 | 0.25 | 0.15 |
| 0.3 | 0.3 | 0.5 | 0.3 | 0.3 | 0.3 | 0.3 | 0.3 | 0.3 | 0.3 | 0.3 | 0.3 | 0.3 | 0.3 | 0.3 | 0.3 | 0.3 | 0.5 | 0.3 | 0.3 | 0.5 | 0.3 | 0.3 | 0.3 |
| 0.45 | 0.45 | 0.5 | 0.45 | 0.45 | 0.45 | 0.45 | 0.45 | 0.45 | 0.45 | 0.45 | 0.45 | 0.45 | 0.45 | 0.45 | 0.45 | 0.45 | 0.5 | 0.45 | 0.45 | 0.5 | 0.45 | 0.45 | 0.45 |
| 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 |
| 0.3 | 0.3 | 0.3 | 0.3 | 0.3 | 0.3 | 0.3 | 0.3 | 0.3 | 0.3 | 0.3 | 0.3 | 0.3 | 0.3 | 0.3 | 0.3 | 0.3 | 0.3 | 0.3 | 0.3 | 0.3 | 0.3 | 0.3 | 0.3 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

SUB-SCANNING DIRECTION

IMAGE FORMING APPARATUS, IMAGE FORMING METHOD, AND STORAGE MEDIUM TO CORRECT AN EDGE EFFECT AND SWEEPING EFFECT

BACKGROUND OF THE INVENTION

Field of the Invention

The present disclosure generally relates to image forming and, more particularly, to an image forming apparatus, an image forming method, a storage medium, and to a technique for reducing excessive amount of color materials consumed in an electro-photographic image forming apparatus.

Description of the Related Art

Conventionally, in a field of an image forming apparatus employing an electro-photographic method, there has been an increased demand for reduction in consumption of toner. For example, Japanese Patent Application Laid-Open No. 2004-299239 discusses a technique for saving consumption of toner by lowering exposure intensity of an image region having a certain size.

Further, it is known that a phenomenon in which an amount of development toner is increased at an rear end portion of a latent image than in a central portion thereof occurs in the electro-photographic image forming apparatus. The above phenomenon is referred to as a sweeping-effect. With respect to the sweeping-effect, Japanese Patent Application Laid Open No. 2007-272153 discusses a technique in which correction processing is executed on image data to correct the sweeping-effect by adjusting an exposure amount.

In addition to a problem of the above-described sweeping-effect, there is a known phenomenon in which an electric field is concentrated on a boundary between an exposure portion (i.e., electrostatic latent image) and a non-exposure portion (i.e., charged portion) formed on a photosensitive drum to cause toner to be excessively adhered to an edge of an image. This phenomenon is referred to as an edge-effect. The edge-effect may occur in concurrent with the above-described sweeping-effect. Therefore, with respect to an image portion in which the sweeping-effect and the edge-effect have occurred concurrently, correction processing suitable for the respective effects has to be executed in order to lower the exposure intensity to reduce excessive toner. If the correction processing suitable for the respective effects cannot be executed, degradation of image density may occur and cause image quality to be deteriorated.

SUMMARY OF THE INVENTION

According to an aspect of the present disclosure, an image forming apparatus includes a printer engine having an exposure unit configured to form an electrostatic latent image based on data of an input image and a development unit configured to develop the formed electrostatic latent image, a specification unit configured to specify a pixel in an edge portion in which an edge-effect and a sweeping-effect are expected to occur, from among a plurality of pixels constituting the input image, and a correction unit configured to correct a toner amount with respect to the pixel in the edge portion in which the edge-effect and the sweeping-effect are expected to occur, which is specified by the specification unit, in order to suppress excessive consumption of toner caused by an effect expected to occur.

According to the present disclosure, excessive toner consumption caused by the edge-effect and the sweeping-effect can be suppressed while preventing deterioration of image quality caused by degradation of image density.

Further features of the present disclosure will become apparent from the following description of exemplary embodiments with reference to the attached drawings.

BRIEF DESCRIPTION OF THE DRAWINGS

FIG. 10 is a diagram illustrating an example of a table used for setting a correction parameter.

FIGS. 11A, 11B, 11C, 11D, and 11E are diagrams illustrating a state where pixels in which the edge-effect may occur is specified.

FIGS. 12A, 12B, 12C, 12D, and 12E are diagrams illustrating a state where pixels in which the sweeping-effect may occur is specified.

FIG. 15 is a diagram illustrating an example of a table prescribing a reduction ratio of an exposure amount reduced by the PWM control.

FIG. 17 is a diagram illustrating an example of a table prescribing a reduction ratio of an exposure amount reduced by the PWM control.

FIGS. 18A, 18B, 18C, 18D, and 18E are diagrams illustrating a state where a correction coefficient is set with respect to a region where toner is to be applied.

DESCRIPTION OF THE EMBODIMENTS

Hereinafter, the present disclosure will be described in detail based on exemplary embodiments with reference to the appended drawings. Configurations described in the exemplary embodiments are merely an example, and the present disclosure is not limited to the configurations illustrated therein.

A first exemplary embodiment will be described below. First, a basic operation of an electro-photographic image forming apparatus will be described as a prerequisite of the present disclosure.

Figure 1:
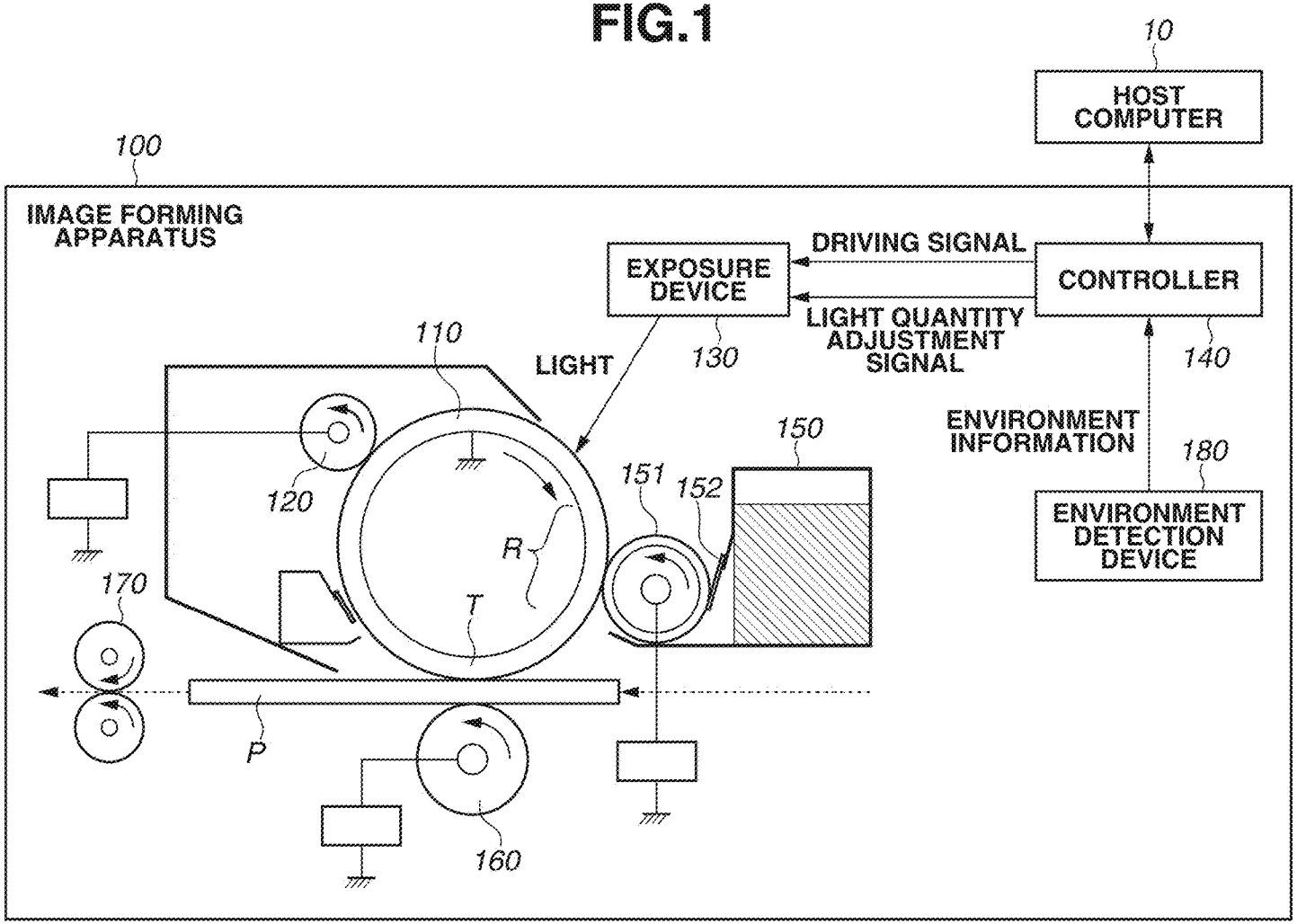
FIG. 1 is a diagram illustrating a basic configuration of an electro-photographic image forming apparatus.

FIG. 1 is a diagram illustrating a basic configuration of an electro-photographic image forming apparatus 100. The image forming apparatus 100 includes a photosensitive drum 110, a charging device 120, an exposure device 130, a controller 140, a development device 150, a transfer device 160, a fixing device 170, and an environment detection device 180. A shaded portion within the development device 150 represents toner as developer. Further, symbols "R", "T", and "P" represents a development region, a transfer position, and a recording medium (i.e., sheet), respectively. In addition, a portion of the image forming apparatus 100 except for the controller 140 and the environment detection device 180, which executes the operation relating to image formation, is referred to as a printer engine.

The photosensitive drum 110 is a drum-shape electro-photographic photoreceptor serving as an image bearing member.

The charging device 120 uniformly charges a surface of the photosensitive drum 110, such as a charging roller.

The exposure device 130 irradiates and exposes the uniformly-charged photosensitive drum 110 with a certain amount of light based on image data. For example, the exposure device 130 includes a laser beam scanner and a surface emitting element. The photosensitive drum 110 is exposed to a laser beam, so that an electrostatic latent image is formed on a surface of the photosensitive drum 110. In other words, light is emitted to the photosensitive drum 110 according to the driving signal output from the controller 140, so that an electrostatic latent image is formed thereon.

The controller 140 outputs the above-described driving signal and a light quantity adjustment signal to the exposure device 130. The exposure device 130 drives a semiconductor laser diode (LD) according to the light quantity adjustment signal to adjust a target light quantity for executing exposure processing. A predetermined amount of electric current is supplied to the exposure device 130 according to the light quantity adjustment signal, so that the exposure intensity is controlled to a certain level. A light quantity is adjusted at each pixel by using the target light quantity as a reference, while the light-emitting time is adjusted through the pulse width modulation, so that gradation of the image can be expressed.

In addition to a toner container for storing and keeping toner, the development device 150 includes a development roller 151 serving as a developer bearing member and a regulation blade 152 functioning as a toner layer thickness regulation member. In the present exemplary embodiment, nonmagnetic mono-component toner is used as the toner. However, two-component toner or magnetic toner may be also used. A layer thickness of the toner supplied to the development roller 151 is regulated by the above-described regulation blade 152. The regulation blade 152 may be configured to apply electric charge to the toner. Then, the toner regulated to a predetermined layer thickness, to which a predetermined amount of electric charge is applied, is conveyed to a development region R by the development roller 151. In the development region R, the development roller 151 and the photosensitive drum 110 come close to or make contact with each other, and the toner is adhered thereto. An electrostatic latent image formed on a surface of the photosensitive drum 110 is developed with toner and converted into a toner image. The toner image formed on the surface of the photosensitive drum 110 is transferred onto a recording medium P at a transfer position T by the transfer device 160. The toner image transferred onto the recording medium P is conveyed to the fixing device 170. The fixing device 170 applies heat and pressure to the toner image and the recording medium P, so that the toner image is fixed onto the recording medium P.

Further, in order to suppress adhesion of excessive toner caused by the edge-effect or the sweeping-effect, the controller 140 executes correction processing for reducing a toner consumption amount on a raster image data transmitted from an image scanner (not illustrated) or a host computer 10. Herein, the edge-effect can be further defined as a phenomenon in which the toner is excessively adhered to a surface of the photosensitive drum 110 at a boundary (i.e., edge) between an exposed region (exposure region) and a non-exposed region (non-exposure region). In other words, because surface potential is different in the exposure region and the non-exposure region, a wraparound electric field occurs at the boundary between the exposure and the non-exposure regions, thereby causing excessive toner to be adhered to the surface thereof. Further, as described above, the sweeping-effect is a phenomenon in which the toner is excessively adhered to a rear end portion in a conveyance direction of an electrostatic latent image.

The adhesion of excessive toner caused by the edge-effect and the sweeping-effect results in excessive consumption of toner in addition to degradation of reproducibility of image density with respect to document density. Therefore, toner can be saved if excessive toner caused by the edge-effect and the sweeping-effect is eliminated.

Figure 2:
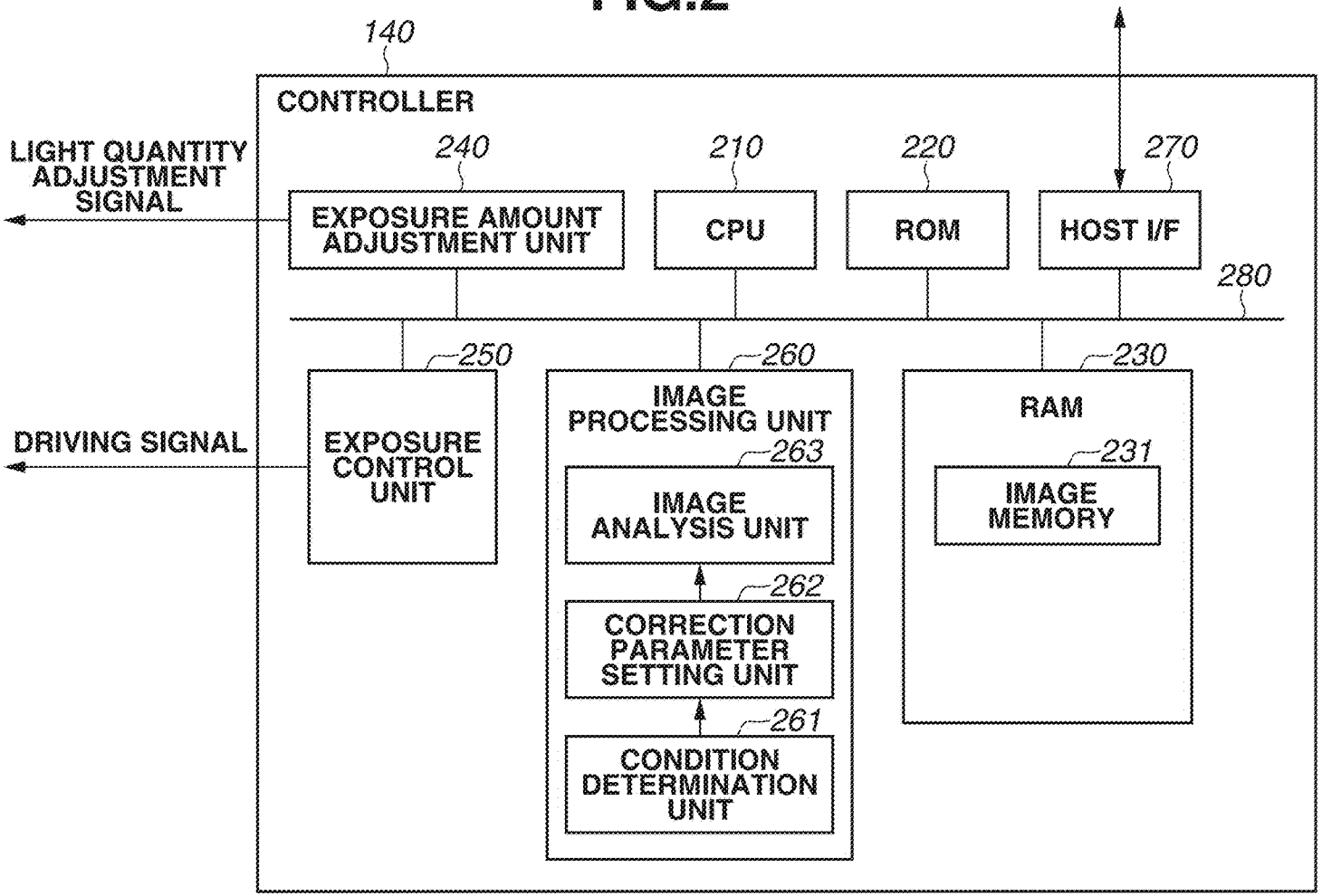
FIG. 2 is a functional block diagram illustrating an internal configuration of a controller.

FIG. 2 is a functional block diagram illustrating an internal configuration of the controller 140. Hereinafter, an operation of the controller 140 will be described together with related peripheral units.

The controller 140 includes a central processing unit (CPU) 210, a read only memory (ROM) 220, a random access memory (RAM) 230, an exposure amount adjustment unit 240, an exposure control unit 250, an image processing unit 260, and a host interface (I/F) 270, which are connected to each other via a bus 280. As used herein, the term "unit" generally refers to any combination of software, firmware, hardware, or other component, such as circuitry, that is used to effectuate a purpose.

The CPU 210 serves as a control unit for generally controlling the entire configuration of the image forming apparatus 100. The CPU 210 executes correction processing according to a program stored in the ROM 220. In the correction processing, a pixel value of a pixel from among a plurality of pixels in an input image, in which the above-described edge-effect or the sweeping-effect is expected to occur, is corrected to reduce the edge-effect or the sweeping-effect. Further, according to a program stored in the ROM 220, the CPU 210 also executes processing for specifying a pixel with excessive toner caused by the edge-effect or the sweeping-effect from among a plurality of pixels in the input image.

The RAM 230 functions as a work memory of the CPU 210 and includes an image memory 231. The image memory 231 is a storage region, such as a page memory or a line memory, where image data regarded as a target of image forming processing is rasterized. Further, the RAM 230 stores a look-up table (LUT) in which a correction parameter (i.e., a pixel width as a correction-target) and a correction coefficient (i.e., a reduction ratio of an exposure amount) are stored.

The exposure amount adjustment unit 240 executes automatic light quantity control (Automatic Photometric Control (APC)) on the light source of the exposure device 130 to set a target light quantity, and generates the above-described light quantity adjustment signal.

The exposure control unit 250 generates a driving signal for controlling the exposure device 130.

The image processing unit 260 includes a condition determination unit 261, a correction parameter setting unit 262, and an image analysis unit 263. The image processing unit 260 executes processing for setting a correction parameter (i.e., information that specifies a pixel width as a correction-target) as preprocessing of the correction processing for reducing the edge-effect and the sweeping-effect.

The host I/F 270 is an interface used to exchange data with the host computer 10.

<Control Processing of Exposure Device>

Figure 3:
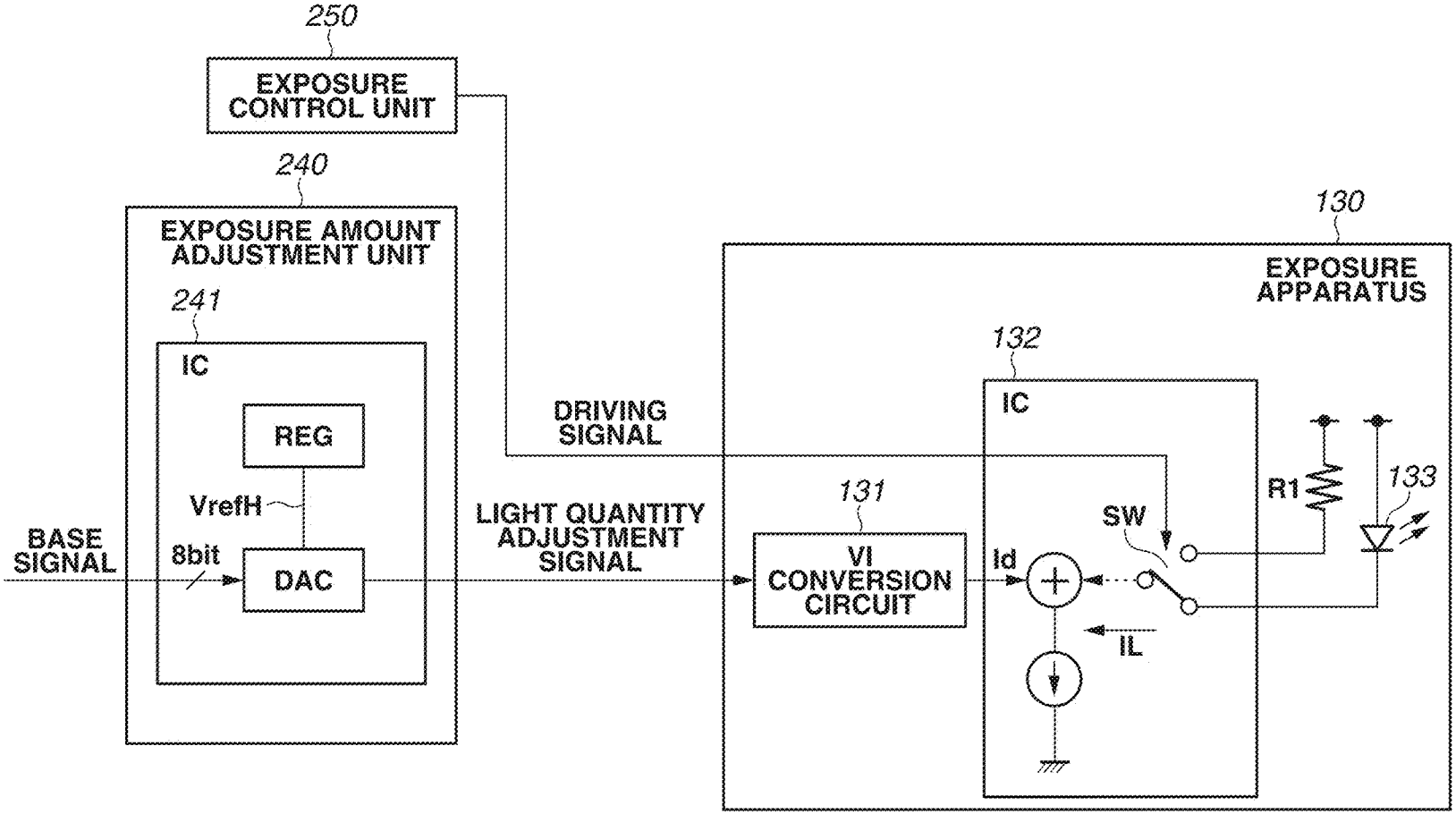
FIG. 3 is a diagram illustrating a state where an exposure device is controlled by a driving signal and a light quantity adjustment signal.

Herein, how the exposure device 130 is controlled by the driving signal and the light quantity adjustment signal will be described. FIG. 3 is a diagram illustrating how the exposure device 130 is controlled by the driving signal and the light quantity adjustment signal.

The exposure amount adjustment unit 240 includes an integrated circuit (IC) 241 that internally includes an 8-bit digital-to-analog (DA) converter and a regulator, and generates and transmits the above-described light quantity adjustment signal to the exposure device 130. A voltage-to-intensity of electric current (VI) conversion circuit 131 that converts voltage into electric current, a laser driver IC 132, and a semiconductor laser 133 are mounted on the exposure device 130.

Based on a base signal that indicates the driving current of the semiconductor laser 133 set by the CPU 210 of the controller 140, the IC 241 of the exposure amount adjustment unit 240 adjusts a voltage VrefH output from the regulator. The voltage VrefH serves as a reference voltage of the DA converter. The IC 241 makes a setting on the data input to the DA converter, so that a light quantity adjustment analog voltage is output from the DA converter as the light quantity adjustment signal.

The VI conversion circuit 131 of the exposure device 130 converts the light quantity adjustment signal received from the exposure amount adjustment unit 240 into an electric current value Id, and outputs the electric current value Id to the laser driver IC 132. Herein, the IC 241 mounted on the exposure amount adjustment unit 240 outputs the light quantity adjustment signal. However, the DA converter may be mounted on the exposure device 130, so that the light quantity adjustment signal is generated near the laser driver IC 132.

The laser driver IC 132 switches a switch SW according to the driving signal output from the exposure control unit 250. The switch SW is used to switch a flow of an electric current IL to either the semiconductor laser 133 or a dummy resistor R1 to execute ON-OFF control of the light emitted from the semiconductor laser 133.

<Control Processing of Image Density>

Figure 4A:
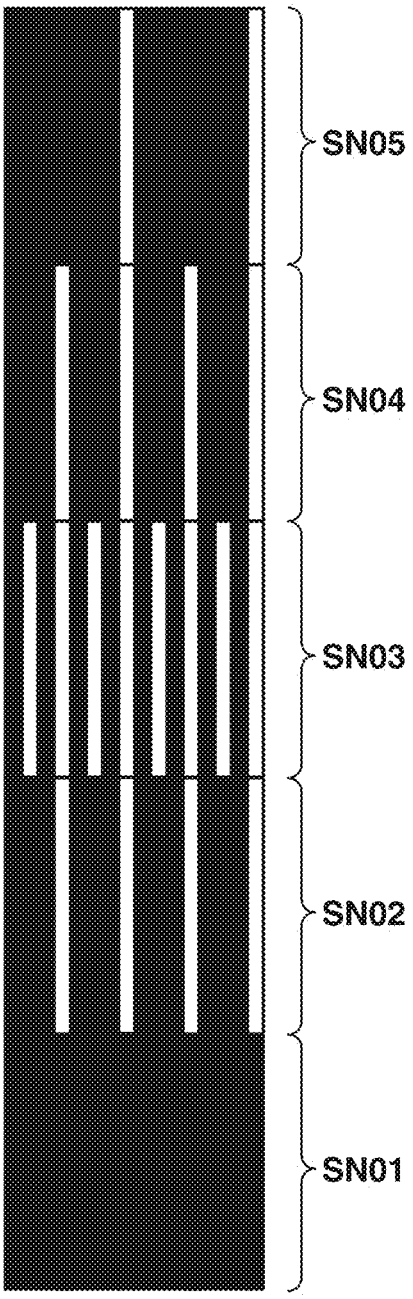
FIGS. 4A and 4B are diagrams illustrating a state where image density is adjusted by pulse width modulation (PWM) control.
Figure 4B:
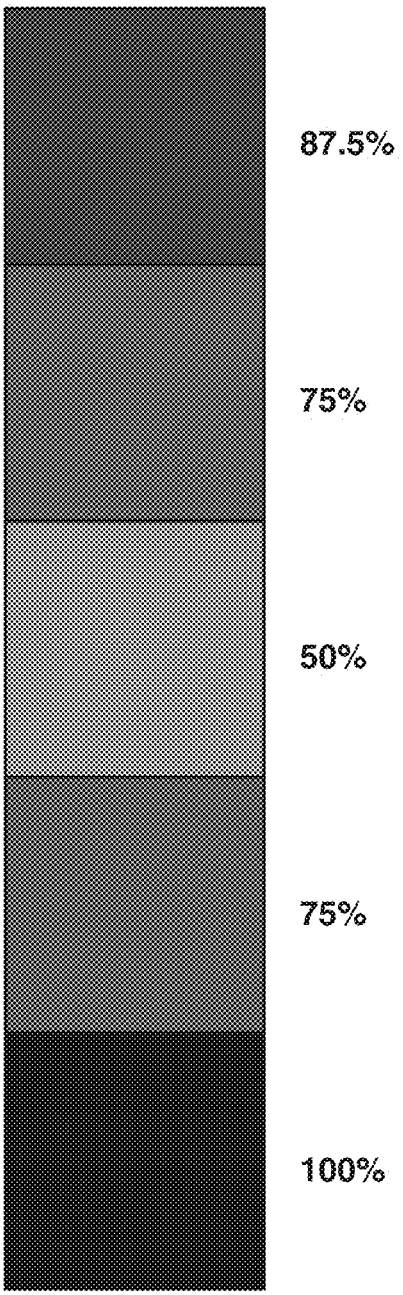

Next, control processing of image density executed by the exposure device 130 will be described. FIGS. 4A and 4B are diagrams illustrating states where the image density is adjusted by the pulse width modulation (PWM) control executed by the exposure device 130. In FIG. 4A, each of images SN01 to SN05 illustrates an image that is formed by dividing one pixel into N pieces (N is a natural number of two or more) of sub-pixels and thinning out a part of the sub-pixels. FIG. 4B is a diagram illustrating image densities corresponding to each of the images SN01 to SN05, and the images SN01, SN02, SN03, SN04, and SN05 have image densities of 100%, 75%, 50%, 75%, and 87.5%, respectively. The density control that realizes these images can be executed when the exposure control unit 250 thins out 100% of light quantity with respect to the target light quantity by the PWM control through the driving signal. For example, if the exposure control unit 250 drives the semiconductor laser 133 only to expose odd-numbered sub-pixels when one pixel is divided into 16 pieces of sub-pixels, it is possible to express an image as in the image SN03 having the image density of 50%.

<Two Types of Development States>

Figure 5A:
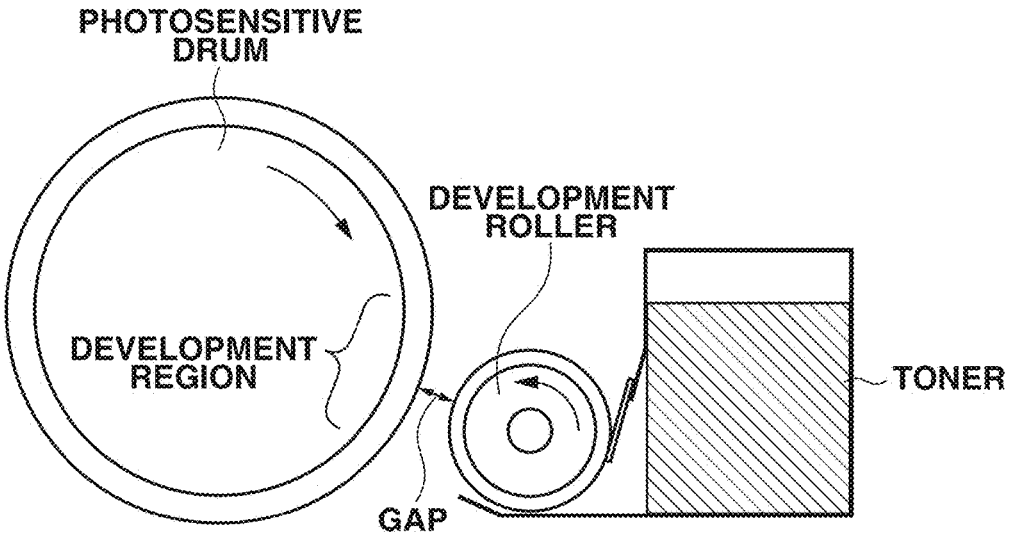
FIGS. 5A and 5B are diagrams respectively illustrating a jumping development state and a contact development state.
Figure 5B:
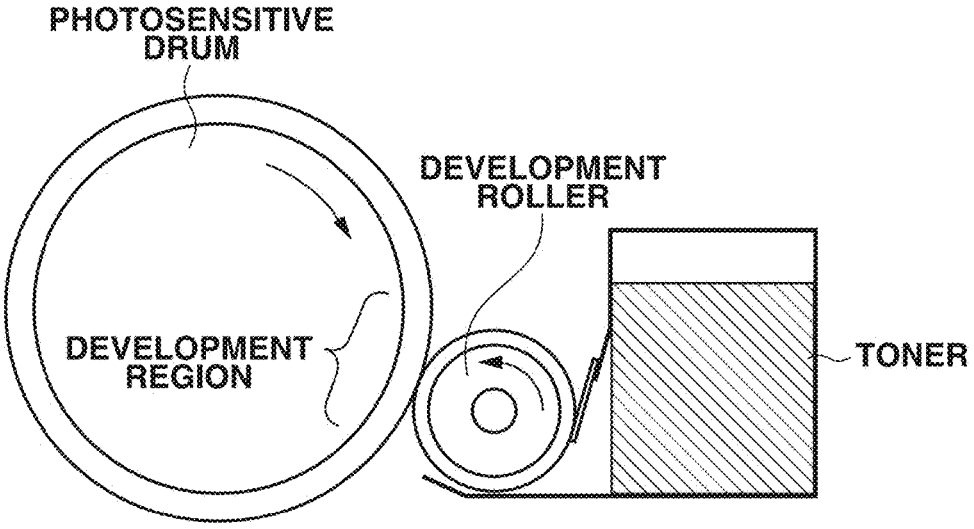

Two types of development states observed in the development device 150 will be described. FIGS. 5A and 5B are diagrams illustrating two types of development states, i.e., a jumping development state (FIG. 5A) and a contact development state (FIG. 5B).

In the jumping development state illustrated in FIG. 5A, development is executed by a development voltage (i.e., an alternating bias voltage on which direct current bias is superimposed) applied to a portion between the development roller and the photosensitive drum, which is generated in a development region where the development roller and the photosensitive drum are closest to each other while being held in a non-contact state. The development device 150 has a gap between the development roller and the photosensitive drum at the development position in the jumping development state. If the gap is too small, leakage of toner from the development roller to the photosensitive drum may easily occur, so that it is difficult to develop the electrostatic latent image. On the other hand, if the gap is too large, the toner will not be able to jump onto the photosensitive drum easily. Therefore, a gap may be designed to maintain an appropriate size by an abutment roller (not illustrated) rotatably supported by a shaft of the development roller.

In the contact development state illustrated in FIG. 5B, development is executed by a development voltage (i.e., direct current bias) applied to a portion between the development roller and the photosensitive drum in the development region where the development roller and the photosensitive drum are closest to each other in a contact state.

In both of the development states illustrated in FIGS. 5A and 5B, the photosensitive drum and the development roller are rotated in a forward direction at different circumferential velocities. Further, a direct current voltage is applied to a portion between the photosensitive drum and the development roller as the development voltage, and the development voltage is set to have a same polarity as that of the charged potential of the photosensitive drum surface. Then, the toner formed into a thin layer on the development roller is conveyed to the development region, so that the electrostatic latent image formed on the photosensitive drum surface is developed thereby.

<Occurrence Principle of Edge-Effect and Sweeping-Effect>

Figure 6:
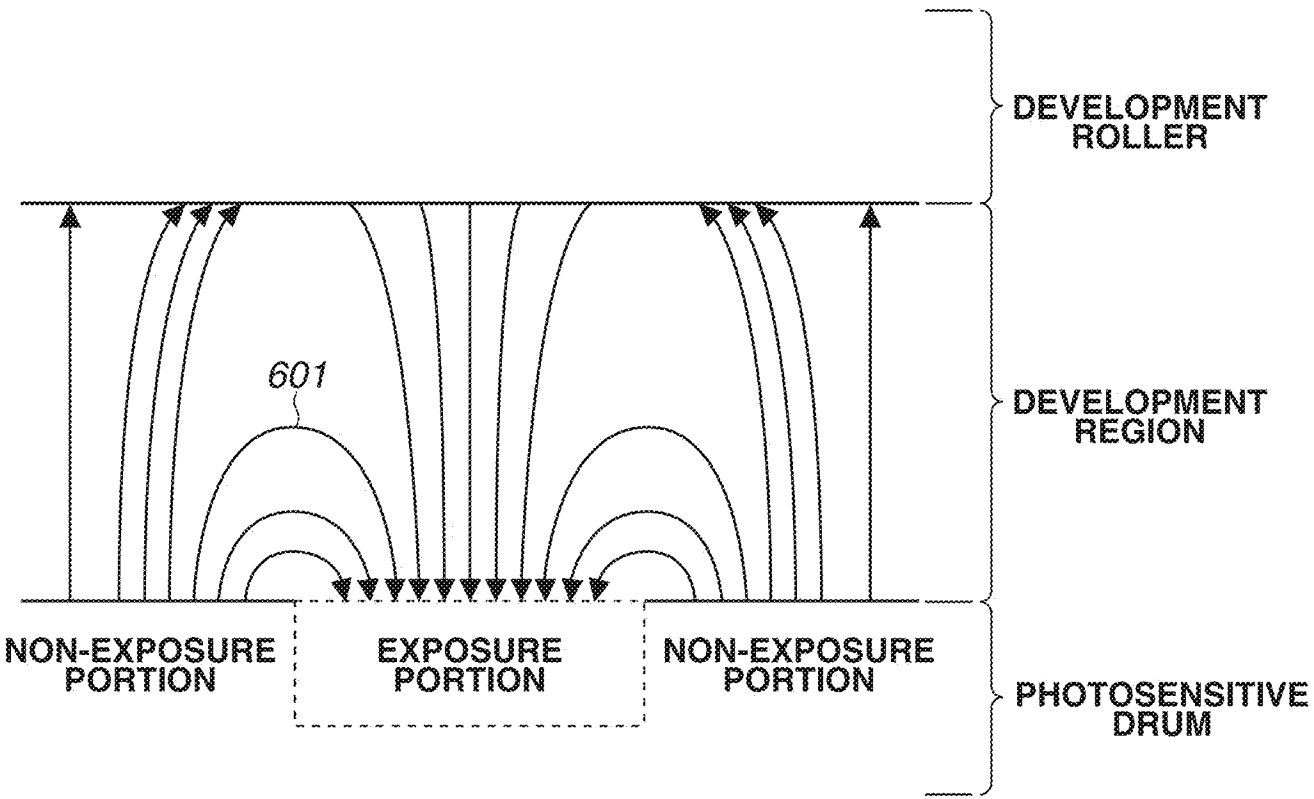
FIG. 6 is a diagram illustrating an edge-effect.

First, occurrence principle of the edge-effect will be described. The edge-effect refers to a phenomenon in which an electric field is concentrated on a boundary between an exposure portion (i.e., electrostatic latent image) and a non-exposure portion (i.e., charged portion) formed on a photosensitive drum, thereby causing toner to be excessively adhered to an edge of an image. FIG. 6 is a diagram illustrating the edge-effect. In FIG. 6, because lines of electric force 601 from the non-exposure portions on both sides of the exposure portion turn around towards the edges of the exposure portion, intensity of the electric field is greater in the edges than in the center of the exposure portion. Therefore, more toner is adhered to the edges than to the center of the exposure portion.

Figure 7A:
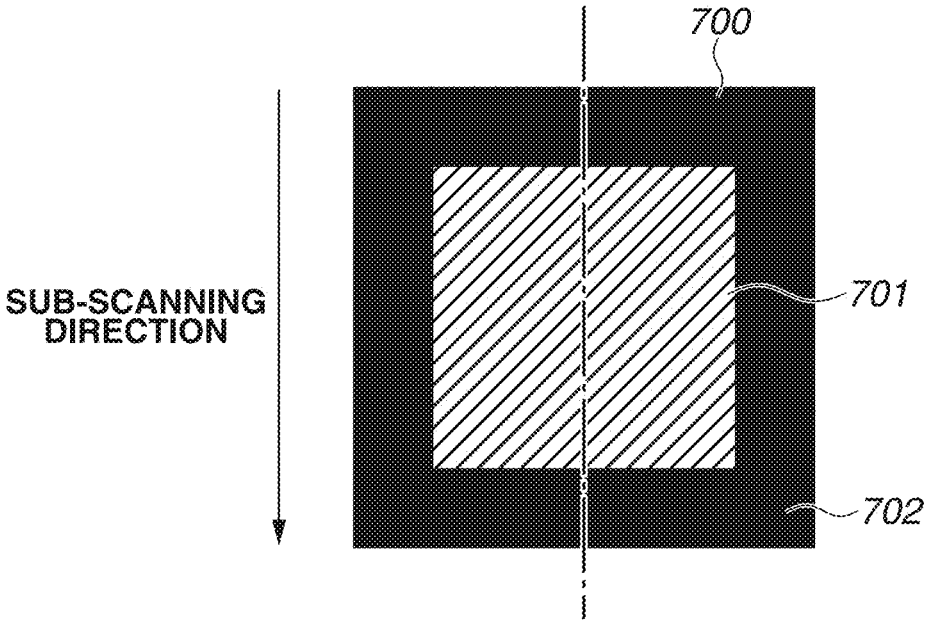
FIGS. 7A and 7B are diagrams respectively illustrating examples of images in which an edge-effect and a sweeping-effect occur.
Figure 8A:
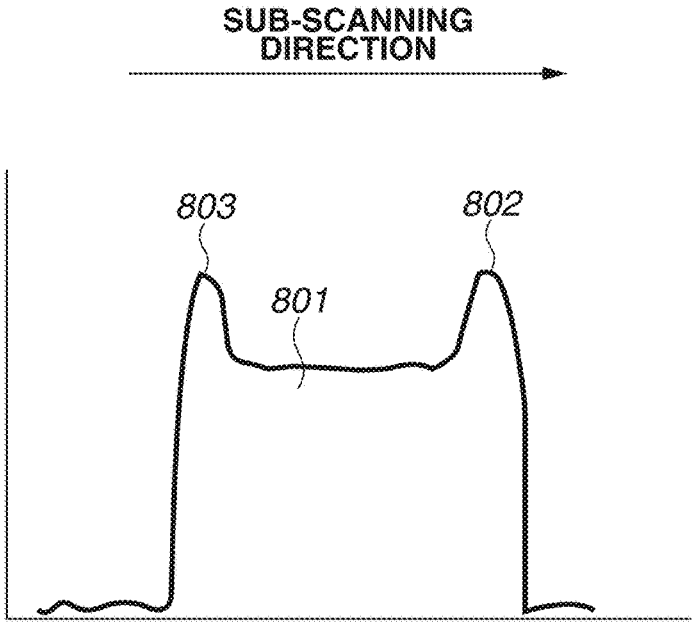
FIGS. 8A and 8B are diagrams respectively illustrating distribution states of toner when the edge-effect and the sweeping-effect occur.

FIG. 7A is a diagram illustrating an example of the image in which the edge-effect occurs. In FIG. 7A, an arrow in a downward direction indicates a conveyance direction of a recording medium on which an image 700 is formed, i.e., a rotation direction of the photosensitive drum also referred to as a sub-scanning direction. According to the image data as an original source of the image 700, the image 700 has uniform density. In a case where the edge-effect occurs, toner is intensively adhered to an edge portion 702 of the image 700. As a result, the density is higher in the edge portion 702 than in a non-edge portion 701. FIG. 8A is a diagram illustrating a distribution state of toner in the image 700. In FIG. 8A, an arrow in a rightward direction indicates a conveyance direction of the recording medium on which the image 700 is formed (i.e., sub-scanning direction). Amounts of toner adhered to an edge portion 802 at the downstream and an edge portion 803 at the upstream in the conveyance direction are greater than the amount of toner adhered to a non-edge portion 801, so that the densities in the edge portions 802 and 803 increase accordingly. Further, the toner adhered to the edge portions 802 and 803 is excessive in amount, and this may lead to an increase in consumption of toner. As described above, the phenomenon in which toner is excessively adhered to the edge portions 802 and 803 occurs because the electric field is concentrated on the edge portions 802 and 803. The edge-effect is frequently observed in the above-described jumping development state. On the contrary, in the contact development state, because a gap between the development roller and the photosensitive drum is extremely small, the electric field is generated toward the development roller from the photosensitive drum, so that concentration of the electric field onto the edge portions is relieved.

Next, occurrence principle of the sweeping-effect will be described. The sweeping-effect refers to a phenomenon in which toner is concentrated on the edge at the rear end portion of the image formed on the photosensitive drum. The sweeping-effect is frequently observed in the contact development state. Hereinafter, the sweeping-effect will be described in detail.

Figure 7B:
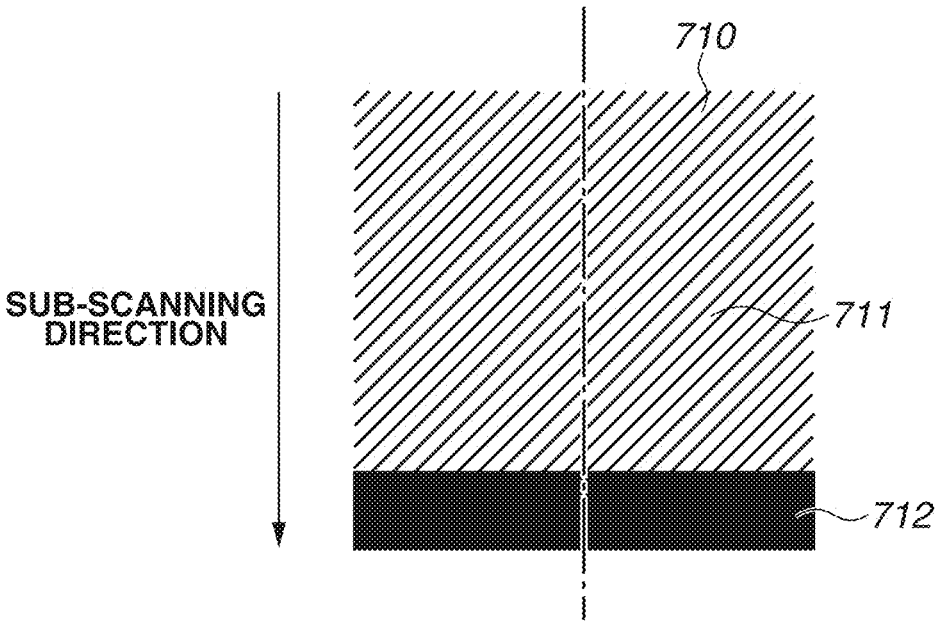
Figure 8B:
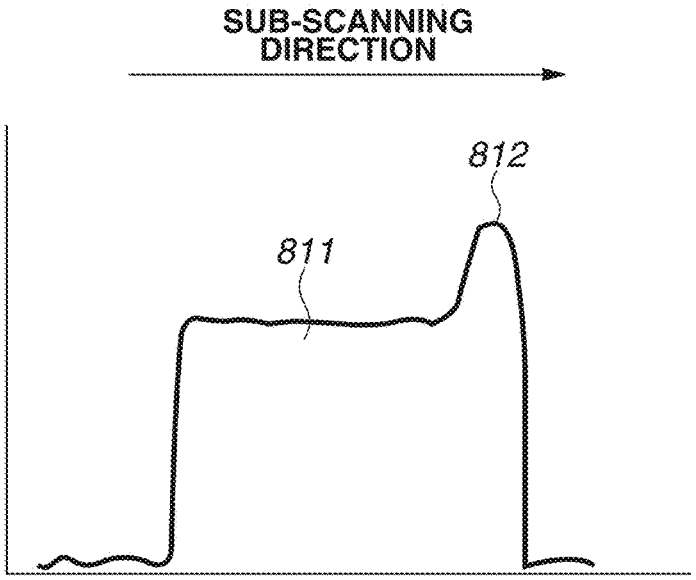

FIG. 7B is a diagram illustrating an example of the image in which the sweeping-effect occurs. In FIG. 7B, an arrow in a downward direction indicates a conveyance direction of a recording medium on which an image 710 is formed (i.e., sub-scanning direction). Similar to the image 700, according to the image data as an original source of the image 710, the image 710 has uniform density. In a case where the sweeping-effect occurs, toner is intensively adhered to a rear end portion 712 of the edges of the image 710. As a result, the density is higher at the rear end portion 712 than in a non-edge portion 711. In FIG. 8B, an arrow in a rightward direction indicates a conveyance direction of a recording medium on which the image 710 is formed (i.e., sub-scanning direction). An amount of toner adhered to a rear end portion 812 at the downstream in the conveyance direction is greater than the amount of toner adhered to a non-edge portion 811, so that the density at the rear end portion 812 increases accordingly. Further, the toner adhered to the rear end portion 812 is excessive in amount, and this may lead to an increase in consumption of toner.

Figure 9A:
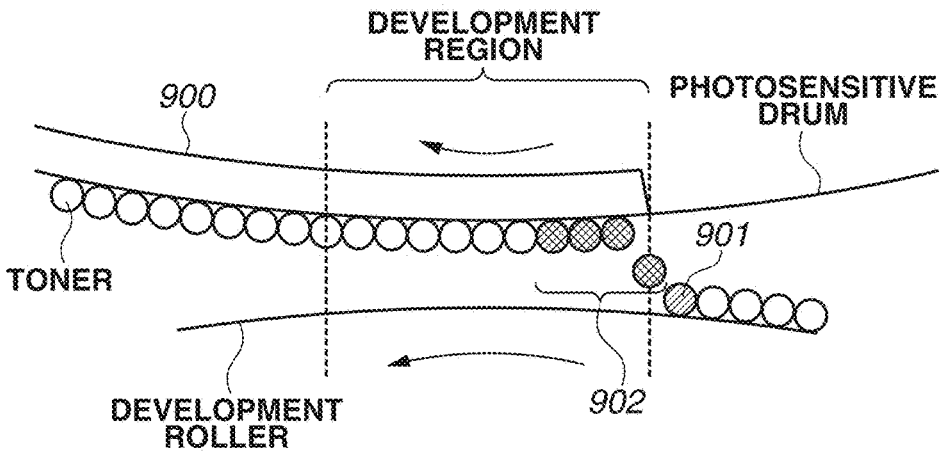
FIGS. 9A, 9B, and 9C are diagrams illustrating occurrence mechanism of the sweeping-effect in the contact development state.
Figure 9B:
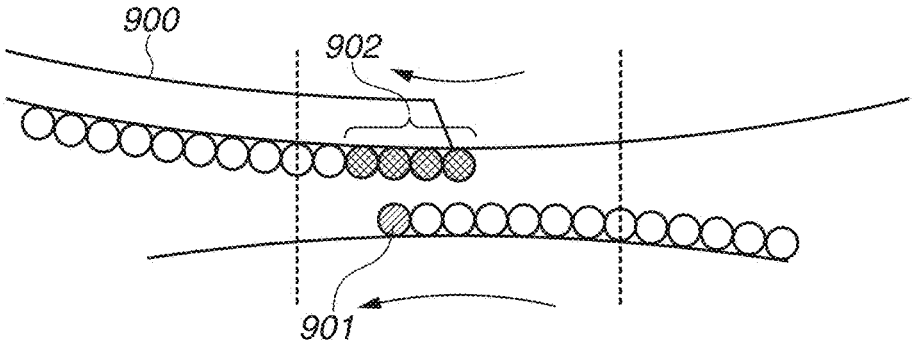
Figure 9C:
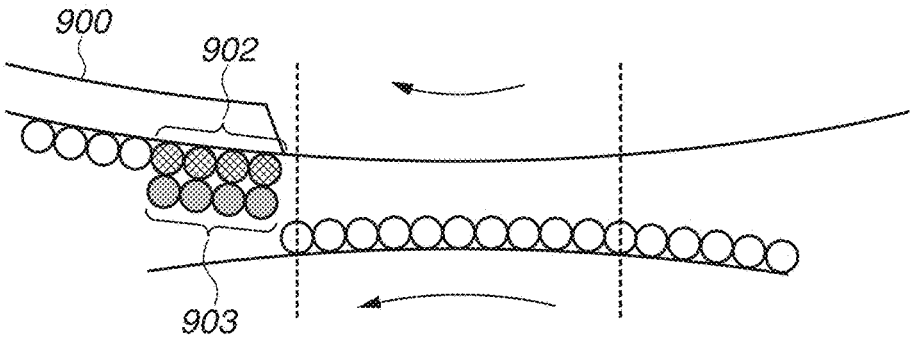

FIGS. 9A, 9B, and 9C are diagrams illustrating occurrence mechanism of the sweeping-effect in the contact development state. In the contact development state, the circumferential velocity of the development roller is set to be faster than the circumferential velocity of the photosensitive drum so that a height of toner on the photosensitive drum becomes a predetermined height. With this configuration, the toner is stably supplied to the photosensitive drum, so that the image density can be maintained to the target density. As illustrated in FIG. 9A, an electrostatic latent image is developed by the toner conveyed by the development roller in the development region. Because the development roller rotates at a speed faster than that of the photosensitive drum, positional relationship between the surfaces of the photosensitive drum and the development roller is constantly changing.+ When a rear end portion of an electrostatic latent image 900 enters the development region, toner 901 on the development roller indicated by hatched lines is positioned rearward than the starting position of the development region in the rotation direction, i.e., rearward than toner 902 at the rear end portion of the electrostatic latent image 900 indicated by cross-hatched lines. Thereafter, as illustrated in FIG. 9B, the toner 901 on the development roller passes the toner 902 at the rear end portion before the toner 902 at the rear end portion moves out of the development region. Then, as illustrated in FIG. 9C, the toner 901 is supplied to the toner 902 at the rear end portion of the electrostatic latent image 900 and adhered thereto as toner 903 indicated in gray color, so that a development amount is increased at the rear end portion. The occurrence mechanism of the sweeping-effect has been described above.

<Correction Processing of Exposure Amount for Reducing Edge-Effect and Sweeping-Effect>

Next, correction processing of the exposure amount will be described. In the processing, image data for forming an electrostatic latent image is corrected to reduce the edge-effect and the sweeping-effect.

First, preprocessing for the correction processing of the exposure amount is executed by the image processing unit 260. The CPU 210 controls the image processing unit 260 according to a program to execute the preprocessing. Hereinafter, the preprocessing will be described in detail.

First, input image data transmitted from the host computer 10 is stored in the image memory 231. The image processing unit 260 receives apparatus state information indicating the state of the image forming apparatus 100 and inputs the apparatus state information to the condition determination unit 261. In addition to peripheral environment information such as internal and external temperatures and humidity of the image forming apparatus 100 acquired by the environment detection device 180, the apparatus state information includes information indicating durability of the members, such as the photosensitive drum and toner, which is estimated based on a total number of output sheets and a total operating time separately acquired by the controller 140. The condition determination unit 261 determines condition of the correction according to the received apparatus state information. In the present exemplary embodiment, based on the information indicating durability and the environment information, the condition is divided into four levels from "Condition 1" in which a large correction target region (i.e., a group of pixels in a predetermined width as a correction target) is specified to "Condition 4" in which a small correction target region is specified. Then, information indicating determined condition (hereinafter, referred to as "condition information") is input to the correction parameter setting unit 262. Based on the received condition information, the correction parameter setting unit 262 sets a predetermined pixel width to be a correction-target (i.e., number of pixels from an edge portion of an image) as a correction parameter. FIG. 10 is a diagram illustrating an example of a table used for setting the correction parameter. Relationships between various conditions and the above-described correction parameters related to the edge-effect and the sweeping-effect are previously acquired through a testing or a simulation, and a table as illustrated in FIG. 10 is created. Then, the created table is stored in the RAM 230. In the table illustrated in FIG. 10, correction parameters according to the above-described four levels of conditions (Conditions 1 to 4) are associated with the edge-effect or the sweeping-effect, so that the correction parameter of the edge-effect or the sweeping-effect can be determined based on the input condition information. In the present exemplary embodiment, although the condition is divided into four levels, the condition can be divided into the arbitrary number of levels according to the density characteristics of photosensitive drum or toner to be used. For example, the condition may be divided into more detailed levels with which the occurrence state of the edge-effect or the sweeping effect may change, and a table in which correction parameters of the edge-effect and the sweeping-effect are associated therewith may be created.

Then, based on the correction parameter set by the correction parameter setting unit 262, the image analysis unit 263 executes specification processing on the image data stored in the image memory 231 to specify a pixel in which the edge-effect and the sweeping-effect may occur. The edge-effect and the sweeping-effect are visible when optical density of the pixel has a value greater than a certain value. Further, the edge-effect occurs in the edge portion of the pixel region whereas the sweeping-effect occurs at the rear end portion of the pixel region. Accordingly, the correction-target pixel can be determined while the above description is taken into consideration, so that the edge-effect and the sweeping-effect can be efficiently reduced.

Figure 11A:
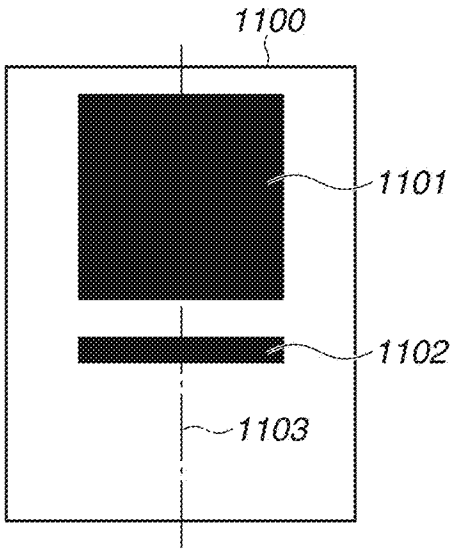

First, a method for specifying the pixel in the edge portion in which the edge-effect may occur will be described. FIGS. 11A to 11E are diagrams illustrating how the pixel in which the edge-effect may occur is specified. FIG. 11A is a diagram illustrating an input image 1100, and two rectangular regions 1101 and 1102 represent regions within the input image 1100 where toner is actually applied and consumed. In addition, an arrow in a downward direction in each of FIGS. 11B to 11E indicates the sub-scanning direction. The image analysis unit 263 receives the input image data from the image memory 231 in a rasterization order, and specifies a correction-target pixel with respect to a plurality of pixels in the input image 1100 based on the set correction parameter (number of correction-target pixels). In an exemplary embodiment described below, it is assumed that the number of correction-target pixels (5-pixel) corresponding to Condition 2 is specified based on the condition information.

FIG. 11B is a diagram illustrating pixel values (8-bit: 0 to 255) of respective pixels constituting the image region 1101 (16×16 pixels). In FIG. 11B, all of the pixels in the image region 1101 are black pixels (i.e., pixel value of 255), whereas all of the pixels in a peripheral region are white pixels (i.e., pixel value of 0). However, the white pixels are not illustrated in FIG. 11B. FIG. 11C is a diagram illustrating the correction-target pixels with respect to the image region 1101, which are specified based on the number of correction-target pixels (5 pixels). A value other than "0" (in FIG. 11C, a value of 1 to 5) is assigned to each of the correction-target pixels, and each of the values indicates a distance from the white pixel. A value "0" is assigned to each of the pixels in a central portion of the image region 1101 regarded as a non-correction target. For convenience of explanation, a size of the image in FIG. 11C is smaller than the actual image size. Therefore, in general, pixels actually included in the central portion of the image region 1101 (i.e., non-correction target pixels), to which the value "0" is assigned, may be more than the pixels illustrated in FIG. 11C. In the present exemplary embodiment, control processing for changing an exposure amount correction ratio will be executed according to a distance from the white pixel. As illustrated in FIG. 11C, the image analysis unit 263 outputs the information specifying the correction-target pixel and the distance between the correction-target pixel and the edge (white pixel) as the analysis result. FIG. 11D is a diagram illustrating pixel values of the pixels constituting the image region 1102 (3×16 pixels). In the image region 1102, the number of consecutive pixels in the sub-scanning direction is 3, which is less than the number of correction-target pixels, i.e., 5. Therefore, pixels in the upper and the lower edge portions in the sub-scanning direction are regarded as the non-correction target pixels regardless of the distance from the edge portion. FIG. 11E is a diagram illustrating the correction-target pixels specified based on the number of correction-target pixels (5 pixels) with respect to the image region 1102. As described above, five pixels from among the consecutive pixels, having a width in the main scanning direction longer than a width affected by the edge-effect (i.e., a pixel width as a correction-target), are regarded as the correction-target pixels, while rest of the pixels are regarded as the non-correction target pixels to which the value "0" is assigned. In the present exemplary embodiment, respective edge-effects of the upper, lower, right, and left edge portions are analyzed simultaneously. However, the edge-effects may be analyzed by separating an image region into the upper and lower portions and the right and left portions, or may be analyzed individually with respect to the upper, lower, right, and left portions.

Figure 12A:
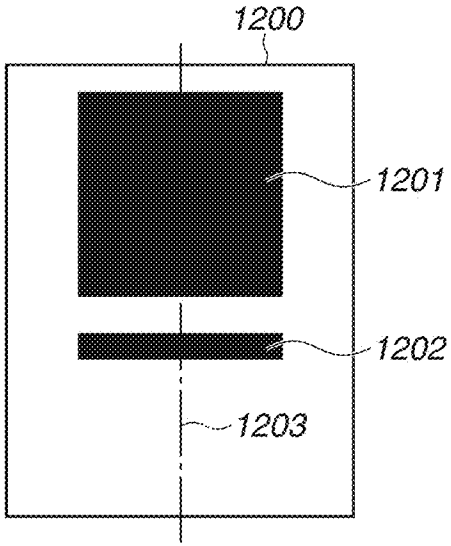

Next, a method for specifying the pixel in the edge portion in which the sweeping-effect may occur will be described. FIGS. 12A to 12E are diagrams illustrating how the pixel in which the sweeping-effect may occur is specified. Similar to FIG. 11A, FIG. 12A is a diagram illustrating an input image 1200, and two rectangular regions 1201 and 1202 represent regions within the input image 1200 where toner is actually applied and consumed. An arrow in a downward direction in each of FIGS. 12B to 12E indicates the sub-scanning direction. The image analysis unit 263 receives the input image data from the image memory 231 in a rasterization order, and specifies the correction-target pixel with respect to a plurality of pixels in the input image 1200 based on the number of correction-target pixels set as the correction parameter. In an exemplary embodiment described below, it is assumed that the number of correction-target pixels (7 pixels) corresponding to Condition 3 is specified based on the condition information.

FIG. 12B is a diagram illustrating pixel values (8-bit: 0 to 255) of respective pixels constituting the image region 1201 (16×16 pixels). In FIG. 12B, all of the pixels in the image region 1201 are black pixels (i.e., pixel value of 255), whereas all of the pixels in a peripheral region are white pixels (i.e., pixel value of 0). However, the white pixels are not illustrated in FIG. 12B. FIG. 12C is a diagram illustrating the correction-target pixels with respect to the image region 1201, which are specified based on the number of correction-target pixels (7 pixels). A value other than "0" is assigned to each of the correction-target pixels, and each of the values indicates a distance from the white pixel. A value "0" is assigned to a pixel in the upper portion of the image region 1201 regarded as the non-correction target. In the present exemplary embodiment, control processing for changing the exposure amount correction ratio will be executed according to a distance from the white pixel. As illustrated in FIG. 12C, the image analysis unit 263 outputs the information specifying the correction-target pixel and the distance from the edge as the analysis result. FIG. 12D is a diagram illustrating pixel values of the pixels constituting the image region 1202 (3×16 pixels). In the image region 1202, number of consecutive pixels in the sub-scanning direction is 3, which is less than the number of correction-target pixels, i.e., 7. Therefore, all of the pixels are regarded as the non-correction target pixels. FIG. 12E is a diagram illustrating the correction-target pixels specified based on the number of correction-target pixels (7 pixels) with respect to the image region 1202. As described above, the value "0" that represents the non-correction target pixel is assigned to all of the pixels.

As described above, information relating to the pixel as a target of the correction processing for reducing the edge-effect and the sweeping-effect is stored in the image memory 231 as the analysis result. Then, from among a plurality of pixels constituting the input image, a pixel value of the pixel (correction-target pixel) in which the edge-effect or the sweeping-effect may occur is corrected by the correction processing described below.

Figure 13:
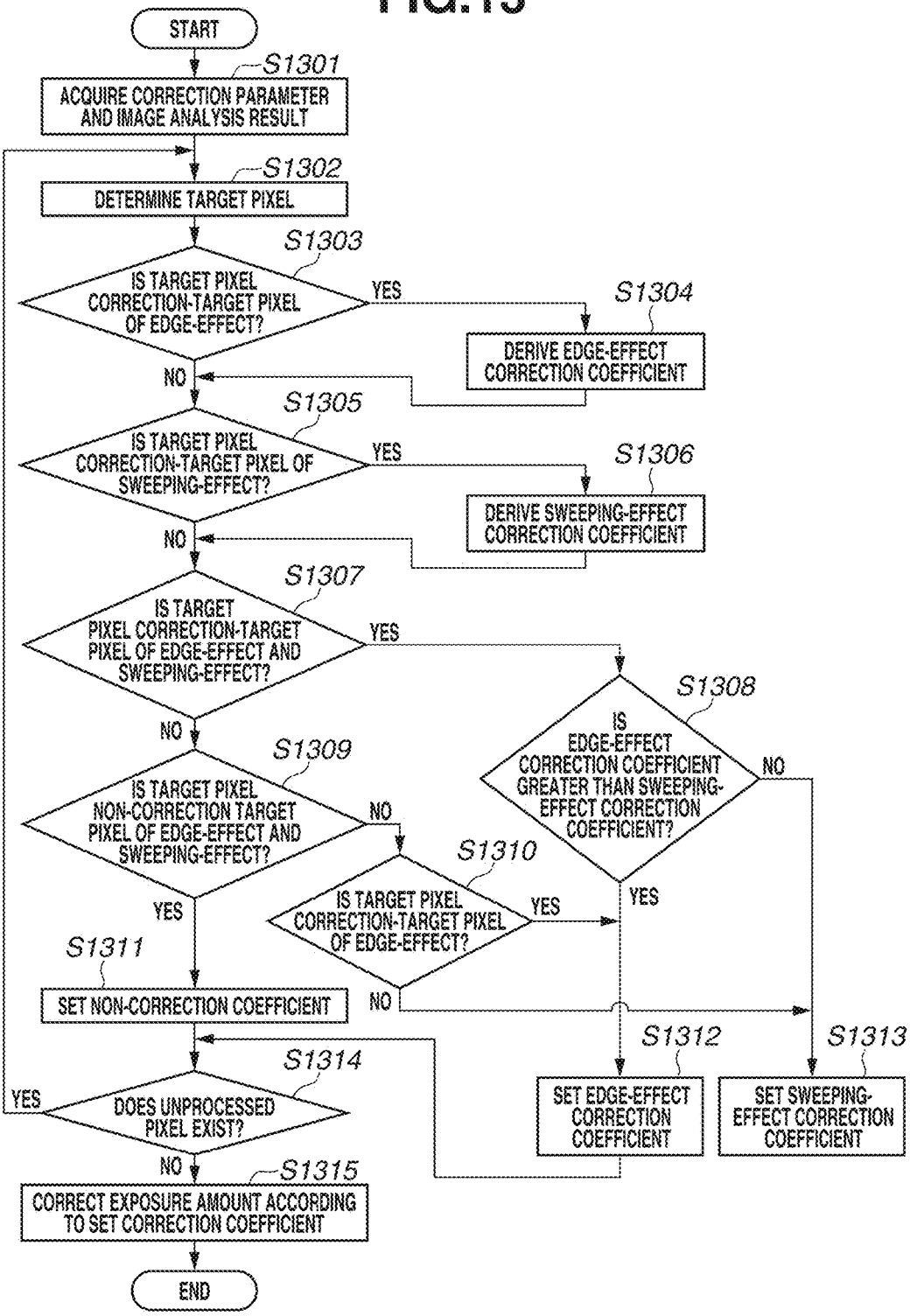
FIG. 13 is a flowchart illustrating a flow of correction processing according to a first exemplary embodiment of the present disclosure.

Next, the correction processing executed by the controller 140 will be described in detail. FIG. 13 is a flowchart illustrating a flow of the correction processing according to the present exemplary embodiment. A series of processing described below is realized when a program stored in the ROM 220 is read to the RAM 230 and executed by the CPU 210. The CPU 210 receives a printing start instruction (i.e., an input of raster image data) from the host computer 10 to start the processing according to the flowchart.

In step S1301, the CPU 210 acquires the correction parameter (i.e., number of correction-target pixels) set by the correction parameter setting unit 262 and the image analysis result (i.e., information specifying the correction-target pixel and the distance from the edge) obtained by the image analysis unit 263.

In step S1302, the CPU 210 determines a target pixel as a processing target from the input image.

In step S1303, based on the analysis result relating to the edge-effect included in the image analysis result acquired in step S1301, the CPU 210 determines whether the target pixel is the correction-target pixel. Specifically, as described above, the value "0" is assigned to the pixel other than the correction-target pixel. Therefore, the CPU 210 determines that the target pixel is the correction-target pixel if the value corresponding to the target pixel is other than "0", while the CPU 210 determines that the target pixel is not the correction-target pixel if the value "0" is assigned thereto. As a result of the determination, if the target pixel is the correction-target pixel of the edge-effect (YES in step S1303), the processing proceeds to step S1304. On the other hand, if the target pixel is not the correction-target pixel of the edge-effect (NO in step S1303), the processing proceeds to step S1305.

Figure 14A:
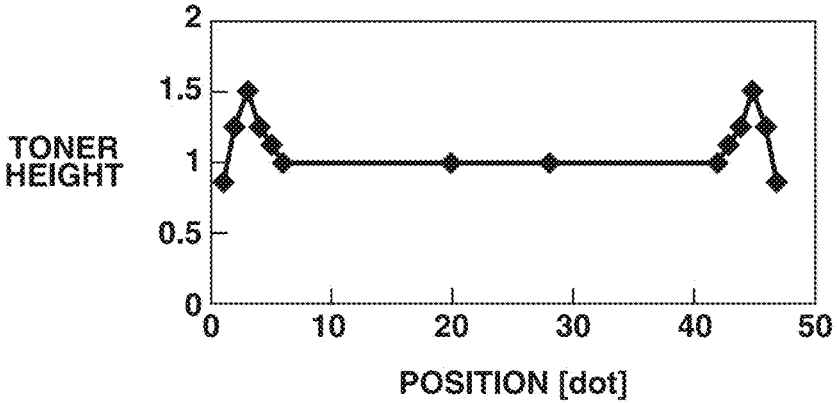
FIGS. 14A, 14B, and 14C are graphs illustrating examples of a toner height and a reduction ratio at the occurrence of the edge-effect.
Figure 14B:
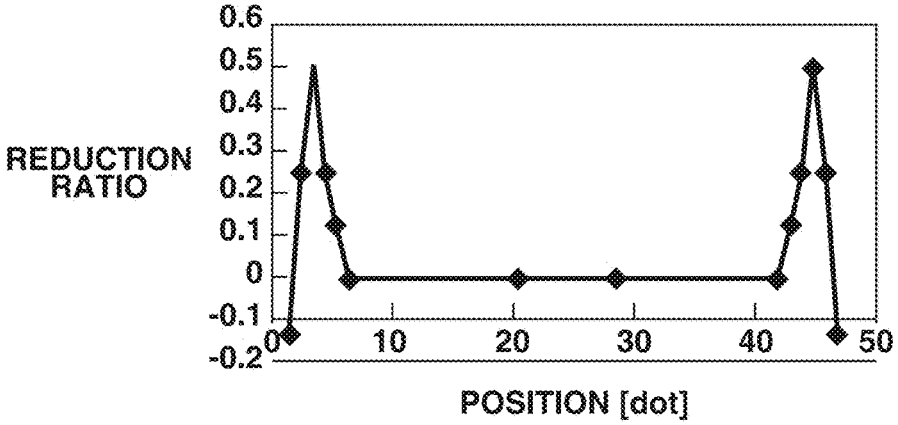
Figure 14C:
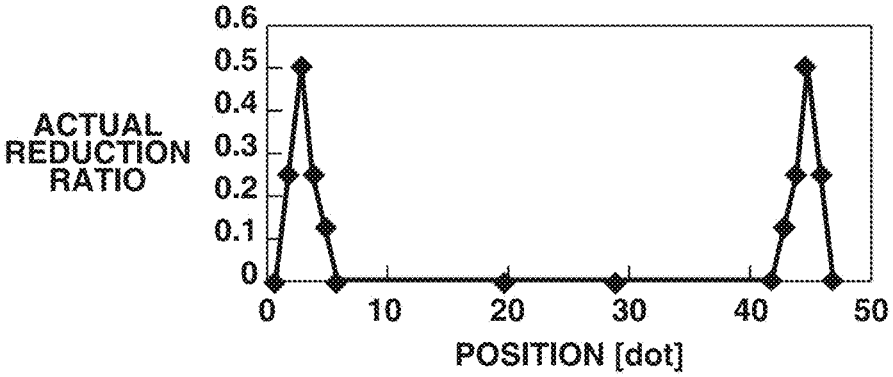

In step S1304, a coefficient of the correction processing for reducing the edge-effect of the target pixel (hereinafter, referred to as "edge-effect correction coefficient") is derived. Herein, a derivation method of the edge-effect correction coefficient will be described in detail. FIGS. 14A to 14C are graphs illustrating examples of a toner height and a reduction ratio at the occurrence of the edge-effect. In FIG. 14A, a vertical axis represents a toner height if a height of the non-edge portion at the cross-section of the image region 1101 taken along a dashed line 1103 in FIG. 11A is whereas a horizontal axis represents the number of dots. In addition, a size of the image region 1101 (16×16 pixels) does not conform to the number of dots. As described above, this is because the image region 1101 is smaller than an actual size of the image. FIG. 14B is a graph illustrating a reduction ratio of toner, which is necessary if the toner height illustrated in FIG. 14A is "1" in the entire region of the image region 1101 (i.e., a correction ratio necessary to correct the excessive height). As illustrated in FIG. 14B, the toner is excessively consumed in the portion where the edge-effect occurs, while there is shortage of toner at the endmost portion of the image. Accordingly, while the correction processing for reducing the exposure amount is executed on the end portion of the image where the edge-effect occurs, the correction processing for increasing the exposure amount has to be executed on the endmost portion of the image. FIG. 14C is a graph illustrating the correction ratio of the toner height necessary to execute the correction processing by the PWM control (although correction processing of the toner height is not executed on the endmost portion). FIG. 15 is an example of a table prescribing the reduction ratio (i.e., correction amount) of the exposure amount reduced by the PWM control to realize the correction necessary to reduce the edge-effect illustrated in FIGS. 14A to 14C. In the table illustrated in FIG. 15, a distance from the edge (white pixel) and a reduction ratio of the exposure amount are associated with each other. Basically, the reduction ratio illustrated in FIG. 14B is directly reflected as the reduction ratio of the exposure amount. However, with respect to a portion closest from the edge (i.e., an endmost portion where the reduction ratio of the toner height has a negative value), the reduction ratio has the value "0" because the exposure amount cannot be increased by the PWM control.

In the present exemplary embodiment, although the values of the reduction ratio of the exposure amount and the reduction ratio of the toner height are the same, a value of the reduction ratio is not limited to the above, and any value may be used as long as it can correct the excessive toner height.

In step S1304, a correction coefficient according to the distance from the edge with respect to the target pixel as the correction-target pixel, i.e., a reduction ratio of the exposure amount, is derived with reference to the table illustrated in FIG. 15. For example, when a value "2" is assigned to the target pixel as the value indicating the distance from the edge, a correction coefficient of "0.25" is derived.

The processing will be further described with reference to the flowchart of FIG. 13, again. In step S1305, based on the analysis result relating to the sweeping-effect included in the image analysis result acquired in step S1301, the CPU 210 determines whether the target pixel is the correction-target pixel. Specifically, as described above, because the value "0" is assigned to the pixel other than the correction-target pixel, the CPU 210 determines that the target pixel is the correction-target pixel if the value corresponding to the target pixel is other than "0", and determines that the target pixel is not the correction-target pixel if the value "0" is assigned thereto. As a result of the determination, if the target pixel is the correction-target pixel of the sweeping-effect (YES in step S1305), the processing proceeds to step S1306. On the other hand, if the target pixel is not the correction-target pixel of the sweeping-effect (NO in step S1305), the processing proceeds to step S1307.

Figure 16:
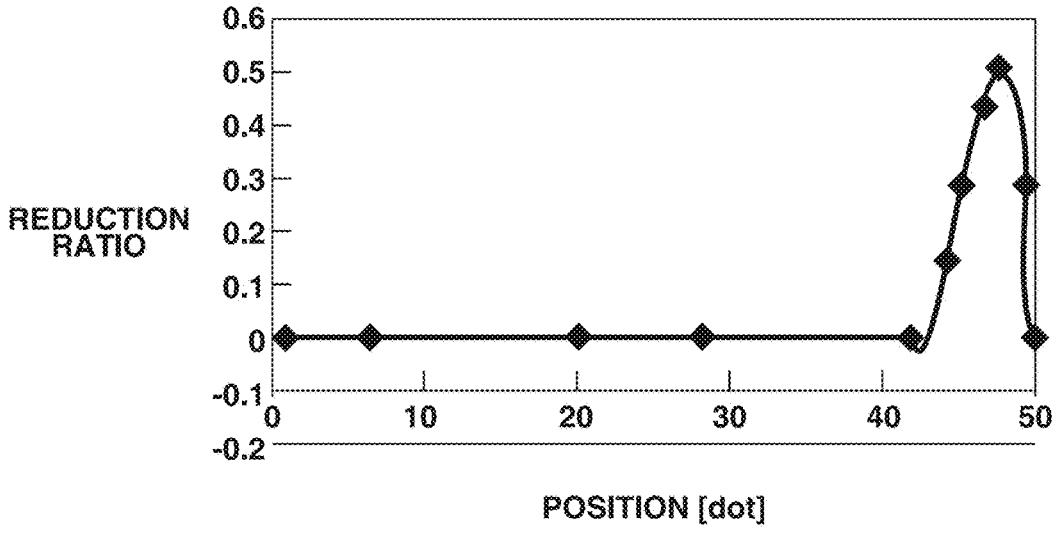
FIG. 16 is a graph illustrating a reduction ratio of toner that is to be reduced at the occurrence of the sweeping-effect.

In step S1306, a coefficient of the correction processing for reducing the sweeping-effect in the target pixel (hereinafter, referred to as "sweeping-effect correction coefficient") is derived. Herein, a derivation method of the sweeping-effect correction coefficient will be described in detail. FIG. 16 is a graph corresponding to the graph illustrated in FIG. 14B, illustrating a reduction ratio of toner necessary if the toner height is "1" in the entire region of the image region 1101 (i.e., a correction ratio necessary to correct the excessive height) at the occurrence of the sweeping-effect. As illustrated in FIG. 16, the toner is excessively consumed in the portion where the sweeping-effect occurs. Therefore, with respect to the portion where the sweeping-effect occurs, it is necessary to execute the correction processing for reducing the exposure amount. FIG. 17 is an example of a table prescribing the reduction ratio of the exposure amount reduced by the PWM control to realize the correction necessary to reduce the sweeping-effect illustrated in FIG. 16. Similar to the table in FIG. 15, in the table illustrated in FIG. 17, a distance from the edge (white pixel) and a reduction ratio of the exposure amount (correction amount) are associated with each other. In the example of the table illustrated in FIG. 17, the reduction ratio illustrated in FIG. 16 is directly reflected as the reduction ratio of the exposure amount. However, any value may be used as long as the excessive toner height can be corrected thereby. In step S1306, a correction coefficient according to a distance from the edge, i.e., a reduction ratio of the exposure amount, with respect to the target pixel as the correction-target pixel is derived with reference to the table illustrated in FIG. 17. For example, when a value "3" is assigned to the target pixel as the value indicating the distance from the edge, a correction coefficient of "0.5" is derived.

The processing will be further described with reference to the flowchart of FIG. 13, again.

In step S1307, based on the image analysis result acquired in step S1301, the CPU 210 determines whether both of the edge-effect and the sweeping-effect occur in the target pixel (i.e., whether the target pixel is the correction-target pixel of both of the effects). In a case where a value other than "0" is assigned to the target pixel with respect to both of the edge-effect and the sweeping-effect (YES in step S1307), the target pixel is determined as the correction-target pixel of both of the effects, so that the processing proceeds to step S1308. On the other hand, in a case where the value "0" is assigned to the target pixel with respect to both or any one of the above effects, (NO in step S1307), the processing proceeds to step S1309.

In step S1308, the CPU 210 compares the edge-effect correction coefficient derived in step S1304 and the sweeping-effect correction coefficient derived in step S1306, and determines whether the edge-effect correction coefficient is greater than the sweeping-effect correction coefficient. Then, the correction coefficient of a greater value is determined as the correction coefficient to be assigned to the target pixel. In other words, when it is expected that both of the edge-effect and the sweeping-effect may occur, the correction processing is executed on either of the edge-effect or the sweeping-effect having a greater correction amount. As a result of the determination, if the edge-effect correction coefficient is greater (YES in step S1308), the processing proceeds to step S1312. If the sweeping-effect correction coefficient is greater (NO in step S1308), the processing proceeds to step S1313.

In step S1309, the CPU 210 determines whether the target pixel is the non-correction target of both of the edge-effect and the sweeping-effect based on the image analysis result acquired in step S1301. In a case where the value "0" is assigned to the target pixel with respect to both of the edge-effect and the sweeping-effect (YES in step S1309), the target pixel is determined as the non-correction target pixel of both of the effects, so that the processing proceeds to step S1311. On the other hand, in a case where a value other than "0" is assigned to the target pixel with respect to both or any one of the above effects, (NO in step S1309), the processing proceeds to step S1310.

In step S1310, the CPU 210 determines whether the target pixel is the correction-target of the edge-effect or the sweeping-effect based on the image analysis result acquired in step S1301. In a case where the value with respect to the edge-effect is other than "0" (YES in step S1310), the target pixel is determined as the correction-target pixel of the edge-effect, so that the processing proceeds to step S1312. On the other hand, in a case where the value with respect to the sweeping-effect is other than "0" (NO in step S1310), the target pixel is determined as the correction-target pixel of the sweeping-effect, so that the processing proceeds to step S1313.

In step S1311, because the correction processing with respect to both of the effects is not necessary, a non-correction coefficient "0" is set as the exposure amount correction coefficient applied to the target pixel.

In step S1312, a value of the edge-effect correction coefficient is set as the correction coefficient applied to the target pixel.

In step S1313, a value of the sweeping-effect correction coefficient is set as the correction coefficient applied to the target pixel.

In step S1314, the CPU 210 determines whether the correction coefficient is determined with respect to all of the pixels in the input image. As a result of the determination, if there is any unprocessed pixel (YES in step S1314), the processing returns to step S1302 so that the processing is continued on the subsequent pixel as the target pixel. On the other hand, if the correction coefficient is determined with respect to all of the pixels (NO in step S1314), the processing proceeds to step S1315. FIGS. 18A, 18B, 18C, 18D, and 18E are diagrams illustrating a state where the correction coefficient is set to the image region 1101 illustrated in FIGS. 11A to 11E. Similar to FIG. 11C described above, FIG. 18A is a diagram illustrating the pixels specified as the correction-target pixels of the edge-effect (correction width: 5 pixels) and the distance from the edge (white pixel) to each of the pixels. A value indicating a distance from the white pixel is assigned to each of the correction-target pixels, and the value "0" represents the non-correction target pixel. Similarly, FIG. 18B is a diagram illustrating the pixel specified as the correction-target pixels of the sweeping-effect (correction width: 7-pixel) and the distance from the rear-end edge (i.e., white pixel at the rear-end portion) to each of the pixels. Then, FIG. 18C is a diagram illustrating the edge-effect correction coefficients set to the correction-target pixels illustrated in FIG. 18A. FIG. 18D is a diagram illustrating the sweeping-effect correction coefficients set to the correction-target pixels illustrated in FIG. 18B. After the determination processing executed in step S1308, the correction coefficients illustrated in FIG. 18E are eventually set to the respective pixels.

In step S1315, the CPU 210 uses the correction coefficients set to the respective pixels to execute processing for correcting each of the pixel values. As a result, the light quantity of 100% with respect to the target light quantity is thinned out by the PWM control according to the driving signal with the corrected exposure amount, so that the exposure amount is adjusted to a desired value that can reduce the edge-effect and the sweeping-effect.

In the present exemplary embodiment, the exposure amount is corrected after the correction coefficient is set to all of the pixels of the input image. However, the exposure amount can be sequentially corrected when the correction coefficient is determined at each of the target pixels. Further, the correction processing may include processing (preprocessing) for specifying a pixel with excessive toner caused by the edge-effect or the sweeping-effect from among the pixels in the input image. In such a case, for example, a predetermined region including a pixel having a pixel value equal to or greater than a predetermined value is acquired from the pixels in the input image, and a predetermined number of pixels from among the pixels positioned in the edge portion of that predetermined region may be specified as the pixels with excessive toner caused by the edge-effect or the sweeping-effect.

The correction processing according to the present exemplary embodiment has been described above. Then, based on the pixel value corrected above, the exposure control unit 250 generates a driving signal. With this driving signal, an amount of toner per pixel is reduced according to the exposure intervals illustrated in FIG. 4A.

In the present exemplary embodiment, a configuration in which the correction processing and its preprocessing are executed by the controller 140 included in the image forming apparatus 100 has been described. However, the configuration is not limited thereto. For example, the same processing may be executed by the host computer 10, and the corrected image data may be input to the image forming apparatus 100.

As described above, according to the present exemplary embodiment, from among a plurality of pixels constituting the input image, a pixel value of the pixel in which the edge-effect or the sweeping-effect of toner may occur is corrected to reduce the edge-effect or the sweeping-effect. With this processing, toner is prevented from being consumed excessively, and an amount of toner consumption can be reduced. Furthermore, as a secondary effect, density of the toner image can conform to expected density of the input image data, and thus the image quality can be also improved.

As described above, according to the present exemplary embodiment, an excessive amount of toner consumption caused by the edge-effect and the sweeping-effect can be suppressed while preventing deterioration of image quality.

Hereinafter, a second exemplary embodiment will be described. In the first exemplary embodiment, in a case where the target pixel is regarded as the correction target of both of the edge-effect and the sweeping effect, the effect having a greater correction coefficient (correction amount) has been selected to correct the exposure amount. In the present and a third exemplary embodiments, a configuration in which content of the correction applied to the target pixel is determined according to the characteristics of the printer engine will be described.

First, in the present exemplary embodiment, a configuration in which correction processing that is more effective is selected from between the edge-effect correction and the sweeping-effect correction according to the characteristics of the printer engine will be described. In addition, description with respect to the configurations common to those described in the first exemplary embodiment will be simplified or omitted, and configurations different from those of the first exemplary embodiment will be mainly described.

Figure 19:
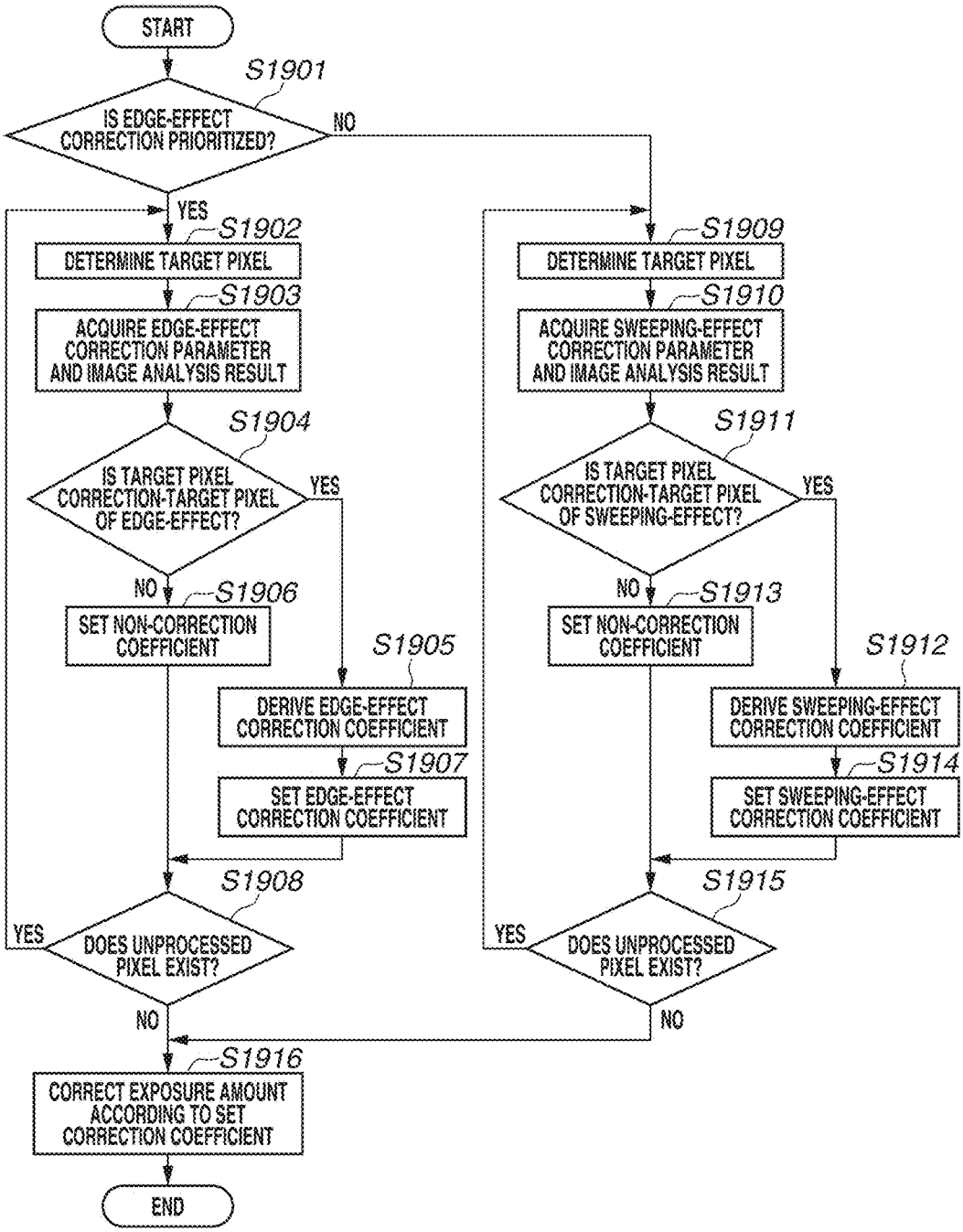
FIG. 19 is a flowchart illustrating a flow of correction processing according to a second exemplary embodiment of the present disclosure.

FIG. 19 is a flowchart illustrating a flow of the correction processing according to the present exemplary embodiment. Similar to the processing flow in FIG. 13 described in the first exemplary embodiment, a series of processing is realized when a program stored in the ROM 220 is read to the RAM 230 and executed by the CPU 210. The CPU 210 receives a printing start instruction (i.e., an input of raster image data) from the host computer 10 to start the processing according to the flowchart.

In step S1901, the CPU 210 determines whether the edge-effect correction is to be prioritized (i.e., determination of a priority mode). A research on a result of the correction processing that can reduce the edge-effect or the sweeping-effect is previously carried out for each type of printer engine, and a priority mode determination flag is set to the image forming apparatus at the time of shipment based on a result of the research. Then, the above determination is executed based on the set priority mode determination flag. Alternatively, the correction processing to be prioritized may be previously selected and set by a user, so that the priority mode is determined when the image forming apparatus is activated. As a result of the determination, if the edge-effect correction is to be prioritized (YES in step S1901), the processing proceeds to step S1902. On the other hand, if the sweeping-effect correction is to be prioritized (NO in step S1901), the processing proceeds to step S1909.

In step S1902, the CPU 210 determines a target pixel as a processing target from the input image.

In step S1903, the CPU 210 acquires the edge-effect correction parameter (i.e., number of correction-target pixels) and the image analysis result of the edge-effect (i.e., information specifying the correction-target pixel and the distance from the edge to the pixel).

In step S1904, based on the image analysis result acquired in step S1903, the CPU 210 determines whether the target pixel is the correction-target pixel of the edge-effect. Details of the determination processing are the same as those in step S1303 of the flowchart in FIG. 13 described in the first exemplary embodiment. As a result of the determination, if the target pixel is the correction-target pixel of the edge-effect (YES in step S1904), the processing proceeds to step S1905. On the other hand, if the target pixel is not the correction-target pixel of the edge-effect (NO in step S1904), the processing proceeds to step S1906.

In step S1905, the edge-effect correction coefficient with respect to the target pixel is derived. Details of derivation processing are the same as those in step S1304 of the flowchart in FIG. 13 described in the first exemplary embodiment.

In step S1906, a non-correction coefficient "0" is set as the correction coefficient of the exposure amount applied to the target pixel.

In step S1907, a value of the edge-effect correction coefficient is set as the correction coefficient applied to the target pixel.

In step S1908, the CPU 210 determines whether the correction coefficient is determined with respect to all of the pixels in the input image. As a result of the determination, if there is any unprocessed pixel (YES in step S1908), the processing returns to step S1902 so that the processing is continued on the subsequent pixel as the target pixel. On the other hand, if the correction coefficient is determined with respect to all of the pixels (NO in step S1908), the processing proceeds to step S1916.

In steps S1909 to S1915, processing the same as the processing with respect to the edge-effect executed in the above-described steps will be executed with respect to the sweeping-effect.

In step S1909, the CPU 210 determines a target pixel as a processing target from the input image.

In step S1910, the CPU 210 acquires the sweeping-effect correction parameter (i.e., number of correction-target pixels) and the image analysis result of the sweeping-effect (i.e., information specifying the correction-target pixel and the distance from the edge to the pixel).

In step S1911, based on the image analysis result acquired in step S1910, the CPU 210 determines whether the target pixel is the correction-target pixel of the sweeping-effect. Details of the determination processing are the same as those in step S1305 of the flowchart in FIG. 13, as described in the first exemplary embodiment. As a result of the determination, if the target pixel is the correction-target pixel of the sweeping-effect (YES in step S1911), the processing proceeds to step S1912. On the other hand, if the target pixel is not the correction-target pixel of the sweeping-effect (NO in step S1911), the processing proceeds to step S1913.

In step S1912, the sweeping-effect correction coefficient with respect to the target pixel is derived. Details of the derivation processing are the same as those in step S1306 of the flowchart in FIG. 13, as described in the first exemplary embodiment.

In step S1913, a non-correction coefficient "0" is set as the correction coefficient of the exposure amount applied to the target pixel.

In step S1914, a value of the sweeping-effect correction coefficient is set as the correction coefficient applied to the target pixel.

In step S1915, the CPU 210 determines whether the correction coefficient is determined with respect to all of the pixels in the input image. As a result of the determination, if there is any unprocessed pixel (YES in step S1915), the processing returns to step S1909 so that the processing is continued on the subsequent pixel as the target pixel. On the other hand, if the correction coefficient is determined with respect to all of the pixels (NO in step S1915), the processing proceeds to step S1916.

In step S1916, the CPU 210 uses the correction coefficient set to each of the pixels to execute the processing for correcting the pixel value. As a result, the light quantity of 100% with respect to the target light quantity is thinned out by the PWM control according to the driving signal with the corrected exposure amount, so that the exposure amount is adjusted to a desired value that can reduce the edge-effect or the sweeping-effect.

The correction processing according to the present exemplary embodiment has been described above. Then, based on the pixel value corrected as the above, the exposure control unit 250 generates the driving signal.

According to the present exemplary embodiment, more effective correction processing is selected from between the edge-effect correction processing and the sweeping-effect correction processing according to the characteristics of the printer engine, thereby an excessive amount of toner consumption caused by the edge-effect and the sweeping-effect can be suppressed while preventing deterioration of image quality.

Next, a configuration in which the exposure amount correction coefficients are combined together according to the characteristics of the printer engine when the target pixel is the correction-target of both of the edge-effect and the sweeping effect will be described as a third exemplary embodiment. In addition, description with respect to the configurations common to those described in the first exemplary embodiment will be simplified or omitted, and configurations different from those of the first exemplary embodiment will be mainly described.

Figure 20:
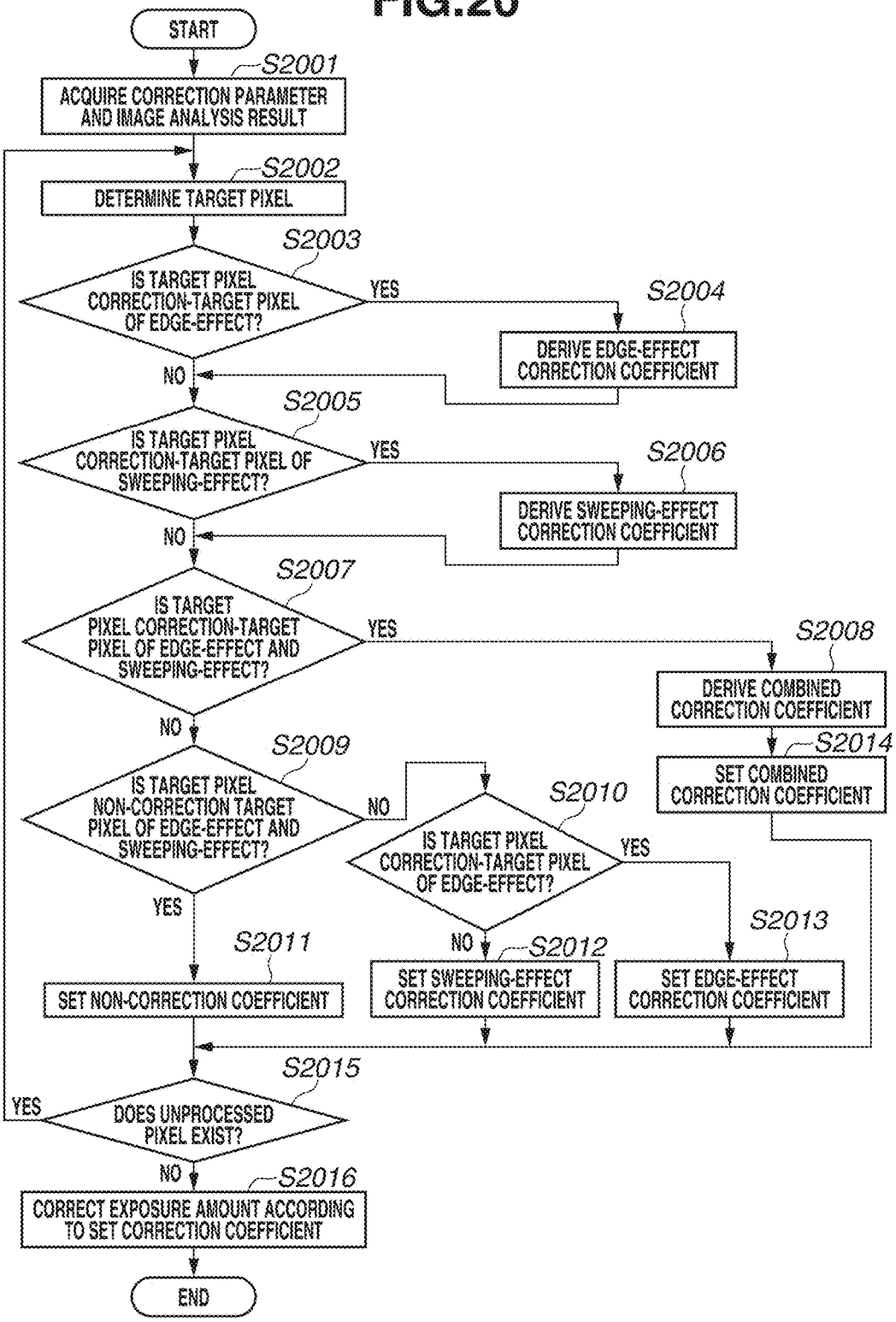
FIG. 20 is a flowchart illustrating a flow of correction processing according to a third exemplary embodiment of the present disclosure.

FIG. 20 is a flowchart illustrating a flow of the correction processing according to the present exemplary embodiment. Steps S2001 to S2006 respectively correspond to steps S1301 to S1306 of the flowchart in FIG. 13 described in the first exemplary embodiment without any difference. Therefore, descriptions thereof will be omitted.

In step S2007, based on the image analysis result acquired in step S2001, the CPU 210 determines whether both of the edge-effect and the sweeping-effect occur in the target pixel. As a result of the determination, in a case where the target pixel is the correction-target pixel of both of the edge-effect and the sweeping-effect (YES in step S2007), the processing proceeds to step S2008. On the other hand, in a case where the target pixel is the non-correction target pixel of both or any one of the above effects (NO in step S2007), the processing proceeds to step S2009.

In step S2008, the CPU 210 derives a combined correction coefficient based on the respective correction coefficients derived in steps S2004 and S2006. Specifically, the CPU 210 uses the following formula 1 to combine the edge-effect correction coefficient and the sweeping-effect correction coefficient to acquire the combined correction coefficient.

$$K=aE+bH< \qquad \text{Formula 1>}$$

In the above formula 1, "K" represents a combined correction coefficient, "E" represents an edge-effect correction coefficient, "H" represents a sweeping-effect correction coefficient, and "a" and "b" represent weighting coefficients. In addition, the weighting coefficients "a" and "b" are previously determined according to the characteristics and the peripheral environment information of the printer engine and stored in the RAM 230. For example, when the edge-effect is to be mainly corrected, the weighting coefficients are set as "a=0.8" and "b=0.5". In the above, for example, if the edge-effect correction coefficient E is "0.5" whereas the sweeping-effect correction coefficient H is "0.25", a value "0.525" can be acquired as the combined correction coefficient K.

Steps S2009 to S2013 respectively correspond to steps S1309 to S1313 of the flowchart in FIG. 13 described in the first exemplary embodiment without any difference. Therefore, descriptions thereof will be omitted.

In step S2014, a value of the combined correction coefficient derived in step S2008 is set as the correction coefficient applied to the target pixel.

In step S2015, the CPU 210 determines whether the correction coefficient is determined with respect to all of the pixels in the input image. As a result of the determination, if there is any unprocessed pixel (YES in step S2015), the processing returns to step S2002 so that the processing is continued on the subsequent pixel as the target pixel. On the other hand, if the correction coefficient is determined with respect to all of the pixels (NO in step S2015), the processing proceeds to step S2016.

In step S2016, the CPU 210 uses the correction coefficient set to the pixel to execute processing for correcting the pixel values. As a result, the light quantity of 100% with respect to the target light quantity is thinned out by the PWM control according to the driving signal with the corrected exposure amount. Therefore, depending on the target pixel, the exposure amount is adjusted to a desired value in which both the edge-effect and the sweeping-effect are taken into consideration.

The present disclosure can be realized in such a manner that a program for realizing one or more functions according to the above-described exemplary embodiments is supplied to a system or an apparatus via a network or a storage medium, and one or more processors in the system or the apparatus reads and executes the program. Further, the present disclosure can be also realized with a circuit (e.g., application specific integrated circuit (ASIC)) that realizes one of more functions.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2014-222553, filed Oct. 31, 2014, which is hereby incorporated by reference herein in its entirety.

What is claimed is:

1. An image forming apparatus comprising:

a printer engine including an exposure unit configured to form an electrostatic latent image based on data of an input image and a development unit configured to develop the electrostatic latent image formed by the exposure unit;

a specification unit configured to specify a pixel in an edge portion in which an edge-effect and a sweeping-effect are expected to occur, from among a plurality of pixels constituting the input image; and a correction unit configured to correct a value of the pixel in the edge portion in which the edge-effect and the sweeping-effect are expected to occur, which is specified by the specification unit, wherein the correction unit corrects the value of the pixel using a first correction amount, which is an amount for correcting the edge-effect, or a second correction amount, which is an amount for correcting the sweeping-effect, whichever is larger.

2. The image forming apparatus according to claim 1, wherein the correction unit corrects a toner amount of the pixel in the edge portion specified by the specification unit so that the toner amount approximates to a toner amount of a pixel in a non-edge portion.

3. The image forming apparatus according to claim 2, wherein, in a case where both of the edge-effect and the sweeping-effect are expected to occur in the pixel in the edge portion specified by the specification unit, the correction unit makes a correction for the edge-effect or the sweeping-effect.

4. The image forming apparatus according to claim 1, wherein the correction unit determines content of a correction applied to the pixel in the edge portion specified by the specification unit according to a characteristic of the printer engine.

5. The image forming apparatus according to claim 4, wherein the correction unit determines a correction that is more effective from between the correction of the edge-effect and the correction of the sweeping-effect as the content of the correction applied to the pixel in the edge portion specified by the specification unit.

6. The image forming apparatus according to claim 4, wherein, in a case where both of the edge-effect and the sweeping-effect are expected to occur in the pixel in the edge portion specified by the specification unit, the correction unit combines contents of the correction of the edge-effect and the correction of the sweeping-effect and determines the combined contents of the corrections as a content of correction applied to the pixel in the edge portion.

7. The image forming apparatus according to claim 6, wherein the correction unit respectively executes weighting on the content of the correction of the edge-effect and the content of the correction of the sweeping-effect to combine the content of the corrections.

8. The image forming apparatus according to claim 7, wherein a weight of the weighting is determined according to at least any one of the characteristic of the printer engine and peripheral environment information including temperature or humidity.

9. The image forming apparatus according to claim 1, wherein the specification unit specifies a group of pixels having a predetermined width from an edge of a region to which toner is applied included in the input image as the pixel in the edge portion in which the edge-effect and the sweeping-effect are expected to occur.

10. The image forming apparatus according to claim 9, wherein the predetermined width is set based on information indicating a state of the image forming apparatus;

wherein the specification unit specifies the group of pixels based on the set predetermined width.

11. The image forming apparatus according to claim 10, wherein the information indicating a state of the image forming apparatus includes at least any one of peripheral environment information that includes temperature or humidity and information that indicates durability of member estimated from a total number of output sheets or a total operating time.

12. The image forming apparatus according to claim 10, wherein each pixel in the group of pixels having the predetermined width specified as the pixel in the edge portion in which the edge-effect and the sweeping-effect are expected to occur is corrected by a different correction ratio according to a distance from an edge.

13. The image forming apparatus according to claim 1, wherein the correction is executed by dividing each of the specified pixels into N-pieces of sub-pixels and thinning out one or more sub-pixels from among the N-pieces of sub-pixels, wherein N is a natural number of two or more.

14. The image forming apparatus according to claim 1, wherein toner amount correction is based on a relationship between a correction parameter for the pixel in the edge portion and state information indicating at least durability and environmental information of the image forming apparatus.

15. An image forming method of an image forming apparatus including a printer engine having an exposure unit configured to form an electrostatic latent image based on data of an input image and a development unit configured to develop the electrostatic latent image formed by the exposure unit, the image forming method comprising:

specifying a pixel in an edge portion in which an edge-effect and a sweeping-effect are expected to occur, from among a plurality of pixels constituting the input image; and correcting a value of the specified pixel in the edge portion in which the edge-effect and the sweeping-effect are expected to occur, wherein the correcting corrects the value of the pixel using a first correction amount, which is an amount for correcting the edge-effect, or a second correction amount, which is an amount for correcting the sweeping-effect, whichever is larger.

16. A non-transitory computer readable storage medium storing a program for causing a computer to perform the following steps of:

specifying a pixel in an edge portion in which an edge-effect and a sweeping-effect are expected to occur, from among a plurality of pixels constituting the input image; and correcting a value of the specified pixel in the edge portion in which the edge-effect and the sweeping-effect are expected to occur, wherein the correcting corrects the value of the pixel using a first correction amount, which is an amount for correcting the edge-effect, or a second correction amount, which is an amount for correcting the sweeping-effect, whichever is larger.

* * * * *